US006155797A

United States Patent [19]

Kazuyoshi

[11] Patent Number: 6,155,797

[45] Date of Patent: Dec. 5, 2000

[54] VARIABLE DISPLACEMENT PUMP

[75] Inventor: Uchino Kazuyoshi, Saitama, Japan

[73] Assignee: Jidosha Kiki Co., Ltd., Japan

[21] Appl. No.: 09/390,401

[22] Filed: Sep. 3, 1999

[30] Foreign Application Priority Data

Sep. 10, 1998 [JP] Japan ..... 10-257278

[51] Int. Cl.[7] ..... F04B 49/00

[52] U.S. Cl. ..... 417/220; 417/559; 418/30

[58] Field of Search ..... 417/220, 559, 417/213; 418/30

[56] References Cited

U.S. PATENT DOCUMENTS

| | | | |
|---|---|---|---|
| 3,656,869 | 4/1972 | Leonard | 417/220 |
| 5,562,432 | 10/1996 | Semba et al. | 418/26 |
| 5,895,209 | 4/1999 | Miyazawa | 418/26 |
| 6,042,343 | 3/2000 | Semba et al. | 417/220 |
| 6,079,955 | 6/2000 | Miyazawa et al. | 417/213 |

FOREIGN PATENT DOCUMENTS

| | | |
|---|---|---|
| 5-278622 | 10/1993 | Japan . |
| 6-200883 | 7/1994 | Japan . |
| 7-243385 | 9/1995 | Japan . |
| 8-200239 | 8/1996 | Japan . |

*Primary Examiner*—Teresa Walberg
*Assistant Examiner*—Vinod D Patel
*Attorney, Agent, or Firm*—Townsend and Townsend and Crew LLP; Kenneth R. Allen

[57] ABSTRACT

In a variable displacement pump, a pump body has an inner surface and is formed with suction and discharge paths communicating with the inner surface. First and second fluid pressure chambers are divisionally formed between the inner surface of the pump body and an outer surface of a cam ring through a seal portion including a swing fulcrum pin. A spring biases the cam ring from the second fluid pressure chamber toward the first fluid pressure chamber. A metering restrictor is provided between the discharge paths. A control valve is connected to the discharge paths formed upstream and downstream, respectively, of the metering restrictor and to the first and second fluid pressure chambers, and is driven by fluid pressures present upstream and downstream of the metering restrictor. The control valve connects each one of the first and second fluid pressure chambers to either one of the discharge paths formed upstream and downstream, respectively, of the metering restrictor, and selectively supplies one of the fluid pressures present upstream and downstream of the metering restrictor to the first and second fluid pressure chambers.

7 Claims, 27 Drawing Sheets

VARIABLE DISPLACEMENT PUMP

BACKGROUND OF THE INVENTION

The present invention relates to a variable displacement pump and, more particularly, to a pressure fluid utilizing equipment such as a power steering device for decreasing the force required to operate the steering wheel of a vehicle.

As a pump for a power steering device, generally, a displacement vane pump directly driven to rotate by a vehicle engine is used. In this displacement pump, the discharge flow rate increases or decreases in accordance with the rotational speed of the engine. A power steering device requires an auxiliary steering force which increases while the vehicle is stopped or is traveling at a low speed and decreases while the vehicle is traveling at a high speed. The characteristics of the displacement pump are contradictory to this auxiliary steering force. Accordingly, a displacement pump having a large volume must be used so that it can maintain a discharge flow rate necessary to produce a required auxiliary steering force even during low-speed driving with a low rotational speed. For high-speed driving with a high rotational speed, a flow control valve that controls the discharge flow rate to a predetermined value or less is indispensable. For these reasons, in the displacement pump, the number of constituent components increases, and the structure and path arrangement are complicated, inevitably leading to an increase in entire size and cost.

In order to solve these inconveniences of the displacement pump, variable displacement vane pumps each capable of decreasing the discharge flow rate per revolution (cc/rev) in proportion to an increase in rotational speed are proposed in, e.g., Japanese Patent Laid-Open Nos. 5-278622, 6-200883, 7-243385, 8-200239, and the like. According to these variable displacement pumps, a flow control valve is unnecessary unlike in a displacement pump. Waste of driving power is prevented to provide an excellent energy efficiency. No return flow to the tank occurs to prevent an increase in oil temperature. In addition, a leakage in the pump and accordingly a decrease in volumetric efficiency can be prevented.

An example of such a variable displacement vane pump will be described briefly with reference to FIGS. 25 to 27 showing the pump structure in Japanese Patent Laid-Open No. 8-200239 or the like. Referring to FIGS. 25 to 27, reference numeral 101 denotes a pump body; 101*a,* an adapter ring; and 102, a cam ring. The cam ring 102 is free to swing in an elliptic space 101*b,* formed in the adapter ring 101*a* of the pump body 101, through a swing fulcrum pin 102*a* serving as a support shaft. A spring means (compression coil spring 102*b*) biases the cam ring 102 to the left in FIGS. 25 to 27. A rotor 103 is accommodated in the cam ring 102 to be eccentric on one side to form a pump chamber 104 on the other side. When the rotor 103 is rotatably driven by an external drive source, vanes 103*a* held to be movable forward/backward in the radial direction are projected and retracted. Reference numeral 103*b* denotes a rotating shaft of the rotor 103. The rotor 103 is driven by the rotating shaft 103*b* to rotate in a direction indicated by an arrow in FIGS. 25 to 27.

First and second fluid pressure chambers 105 and 106 are formed on two sides around the cam ring 102 in the elliptic space 101*b* of the adapter ring 101*a* of the pump body 101, and serve as high- and low-pressure chambers, respectively. Paths 105*a* and 106*a* open to the chambers 105 and 106, respectively, through a spool type control valve 110 (to be described later), to guide as the control pressure for swinging the cam ring 102 the fluid pressures present upstream and downstream of a metering restrictor formed in a pump discharge path 111.

In this case, a variable metering restrictor 112 is formed of a hole 112*a* formed in the side wall surface of the pump body 101 that forms the second fluid pressure chamber 106, and a side edge 112*b* of the cam ring 102 that moves to open/close the hole 112*a.* Reference numeral 113 denotes a pump discharge path formed downstream of the variable metering restrictor 112.

When the fluid pressures of the pump discharge paths 111 and 113 present upstream and downstream of the variable metering restrictor 112 are introduced to the fluid pressure chambers 105 and 106 on the two sides of the cam ring 102, as described above, the cam ring 102 is swung in a required direction to change the volume in the pump chamber 104, as shown in FIGS. 25 and 26, thereby controlling the discharge flow rate in accordance with the flow rate on the pump discharge or outlet side, as shown in the flow rate curve shown in FIG. 28. In other words, the flow rate can be increased to a predetermined value by increasing the rotational speed of the pump, and is maintained at this value. When the rotational speed of the pump is high, the flow rate is decreased.

FIG. 25 shows a state that takes place from regions A to B in FIG. 28, and FIG. 26 shows a state that takes place from the region B to a region C in FIG. 28. In FIG. 26, the cam ring 102 swings to the right to restrict the variable metering restrictor 112. The pump discharge flow rate decreases in accordance with the restriction amount. When the variable metering restrictor 112 is restricted to the minimum position, the pump discharge flow rate is maintained at a predetermined value.

FIG. 27 shows a relief state in the region A of FIG. 28 wherein the pump is driven to rotate at a low speed. In this state, the pressure fluid utilizing equipment is actuated and the fluid pressure of the pump discharge side becomes a relief pressure. In the relief state in the region C of FIG. 28 wherein the pump is driven to rotate at a high speed, a relief valve 115 is open in FIG. 27 to control the relief flow rate in accordance with the open state of the variable metering restrictor 112.

In FIGS. 25 to 27, a pump suction opening (suction port) 107 is formed to oppose a pump suction region 104A of the pump chamber 104. A pump discharge opening (discharge port) 108 is formed to oppose a pump discharge region 104B of the pump chamber 104. These openings 107 and 108 are formed in at least corresponding ones of a pressure plate and a side plate (not shown) serving as stationary wall portions for holding pump constituent elements composed of the rotor 103 and cam ring 102 by sandwiching them from two sides.

The cam ring 102 is biased by the compression coil spring 102*b* from the fluid pressure chamber 106 and is urged in a direction to keep the volume in the pump chamber 104 maximum. A seal member 102*c* is placed in the outer peripheral portion of the cam ring 102 to define the fluid pressure chambers 105 and 106, together with the swing fulcrum pin 102*a,* on the right and left sides.

The spool type control valve 110 is actuated by differential pressures P1 and P2 obtained upstream and downstream of the variable metering restrictor 112, e.g., a metering orifice, formed between the pump discharge paths 111 and 113. The control valve 110 introduces a fluid pressure P3 corresponding to the magnitude of the pump discharge flow rate to the high-pressure fluid pressure chamber 105 outside the cam ring 102, to maintain a sufficiently large flow rate is maintained even immediately after the pump is started.

While the pressure fluid utilizing equipment (indicated by PS in FIGS. 25 to 27) is actuated to apply a load, when the differential pressures present upstream and downstream of the variable metering restrictor 112 become equal to or higher than a predetermined value, the control valve 110 introduces the fluid pressure P1 obtained upstream of the variable metering restrictor 112 as a control pressure to the high-pressure fluid pressure chamber 105 outside the cam ring 102, to prevent swing of the cam ring 102.

The pump body 101 is formed with a pump suction path 114 extending from a tank Ta to the pump suction region 104A of the pump chamber 104 through the low-pressure chamber of the spool type control valve 110.

The pump discharge path 113 is formed with the direct coupled type relief valve 115 serving as a pressure control valve. The relief valve 115 is formed at such a position that, when the pump discharge fluid pressure becomes equal to or higher than a predetermined value, it relieves the pressure fluid to the pump suction side (or tank Ta) through the pump suction path 114.

With this direct coupled type relief valve 115, during operation of the pump as shown in FIG. 27, when the pump discharge fluid pressure reaches a preset value or more, the flow of the fluid can be partly or entirely relieved to the pump suction side (tank Ta side). In particular, since the variable displacement pump does not have a flow control valve unlike in a displacement pump, the direct coupled type relief valve 115 is necessary to relieve the pressure fluid from the pump discharge side to the pump suction side.

In the conventional variable displacement pump having the above structure, when the pump is rotated at a low speed, the high-pressure (first) fluid pressure chamber 105 formed on one side of the cam ring 102 is set at the tank pressure, as shown in FIG. 25. Thus, an internal leakage inevitably increases particularly between the first and second fluid pressure chambers 105 and 106. More specifically, the pump discharge fluid pressure is introduced to the second fluid pressure chamber 106, to produce a large pressure difference between the second fluid pressure chamber 106 and the first fluid pressure chamber 105 which is set at the tank pressure. An internal leakage accordingly occurs around the swing fulcrum pin 102*a* that seals the fluid pressure chambers 105 and 106 from each other together with the seal member 102*c*.

The internal leakage includes leakage in the pump chamber 104 from the pump discharge region 104B to the first fluid pressure chamber 105 through the side surface of the cam ring 102, and leakage of the fluid pressures present upstream and downstream of the variable metering restrictor 112 guided to the two ends of the spool type control valve 110 over the lands of the spool to flow into the annular groove at the center of the spool where the tank pressure is introduced. Since the control valve 110 constantly controls a large pressure difference between the fluid pressure obtained upstream of the variable metering restrictor 112 and the tank pressure, an internal leakage cannot be avoided.

When such an internal leakage in the pump increases, the driving efficiency of the pump decreases. To avoid this, the portion where the internal leakage described above occurs must be machined with strict precision. This increases the manufacturing cost in turn.

In the conventional variable displacement pump described above, the control pressures acting on the fluid pressure chambers 105 and 106 on the two sides of the cam ring 102 to swing it are obtained by distributing the pump discharge fluid pressure and the tank pressure in accordance with the opening area of the lands of the spool in the control valve 110 to the path hole (path 105*a*) of the pump body 101.

In this control valve 110, as the control pressures increase, the area ratio increases. Then, the control valve 110 cannot sometimes follow this increase, and the characteristics of the pump rotational speed (N) with respect to the pump supply flow rate (Q) fluctuates to produce pulsation, as indicated by a broken line in FIG. 28. When this fluctuation occurs, the steering force may fluctuate in the power steering device, or noise such as fluid noise may be produced.

In order to improve the followability of the spool type control valve 110, particularly to allow smooth swing of the cam ring 102 moved by the fluid pressures controlled by the valve 110, the pressure difference between the first and second fluid pressure chambers 105 and 106 on the two sides of the cam ring 102 may be increased. According to the most general conventional structure, the pump discharge pressure is introduced to one fluid pressure chamber while the tank pressure is introduced to the other fluid pressure chamber. With this structure, however, the problem of internal leakage in the pump described above cannot be avoided.

Japanese Patent Laid-Open No. 9-273487 (corresponding to U.S. Pat. No. 5,895,209) proposes the following structure. A control valve for controlling swing of a cam ring is omitted. Fluid pressures present upstream and downstream of a metering restrictor directly act on the first and second fluid pressure chambers around the cam ring. On the inner surface of the cam ring, the position of a swing fulcrum pin is shifted in the circumferential direction from a range on which the pump discharge fluid pressure acts. This structure aims at balancing the pump discharge fluid pressures, that act on the cam ring, on the two sides of the swing fulcrum pin.

More specifically, in the variable displacement pump having the above structure, the fluid pressure, particularly, the pump discharge fluid pressure generates an unbalanced force between the pump suction and discharge opening positions of the pump chamber formed between the rotor and cam ring and the pin position serving as the swing fulcrum pin of the cam ring, i.e., the first and second fluid pressure chambers formed on the two sides of the cam ring. The pressure difference between the right and left sides is present in the pump chamber discharge regions corresponding to the first and second fluid pressure chambers. This pressure difference causes generation of a force for swinging the cam ring toward the second fluid pressure chamber (low pressure side), resulting in the unbalanced state. This pump, therefore, must have a structure which allows absorbing the above unbalanced force.

In this structure, various problems posed by pump machining, e.g., the machining precision and assembly precision of the respective portions of the pump, i.e., the cam ring, the swing fulcrum pin, the pump discharge opening that opens to the pump chamber, and the like are significant in obtaining an adequate swing motion of the cam ring about the swing fulcrum pin as the fulcrum, and machinability and assembly pose problems. If a low machining precision or assembly precision causes a manufacturing error, the swing motion of the cam ring about the swing fulcrum pin as the fulcrum may become unstable. If an unbalance occurs between the right and left sides of the cam ring about the swing fulcrum pin as the center, desired pump characteristics (flow rate characteristics) are difficult to obtain.

A structure is therefore sought for in which the problems accompanying the machining precision and the like are considered, the internal leakage as described above is solved, and the swing motion of the cam ring, particularly the return swing, can be performed smoothly, while the performance as the variable displacement pump can be effected.

SUMMARY OF THE INVENTION

The present invention has been made in view of the above situation, and has as its principal object to provide a variable displacement pump in which the internal leakage caused by the fluid pressure difference in the pump is improved without an improvement in machining precision that increases the manufacturing cost.

It is another significant object of the present invention to provide a variable displacement pump in which the swing motion of the cam ring, particularly the swing motion of the cam ring when the pump returns from high-speed rotation to low-speed rotation, is performed smoothly, so the characteristics of the pump rotational speed (N) with respect to the pump supply flow rate (Q) do not fluctuate to cause pulsation.

In order to achieve the above objects, according to the present invention, there is provided a variable displacement pump comprising a pump body having an inner space and formed with a suction path and discharge paths communicating with the inner space, a cam ring having a swing fulcrum pin on part of an outer surface thereof to extend in an axial direction, and swingably supported in the inner space of the pump body through the swing fulcrum pin as a fulcrum, a rotor having vanes and arranged inside the cam ring to be eccentric on one side of the cam ring, a rotating shaft mounted on an axis of the rotor and axially supported by the pump body, a pump chamber having an opening for the suction path and an opening for the discharge path and formed between an inner surface of the cam ring and an outer surface of the rotor, first and second fluid pressure chambers divisionally formed between the inner space of the pump body and an outer surface of the cam ring through seal means including the swing fulcrum pin, biasing means for biasing the cam ring from the second fluid pressure chamber toward the first fluid pressure chamber, a metering restrictor provided between the discharge paths, and a control valve connected to the discharge paths formed upstream and downstream, respectively, of the metering restrictor and to the first and second fluid pressure chambers and driven by fluid pressures present upstream and downstream of the metering restrictor, wherein the control valve connects each of the first and second fluid pressure chambers to either one of the discharge paths formed upstream and downstream, respectively, of the metering restrictor, and selectively supplies one of the fluid pressures present upstream and downstream of the metering restrictor to the first and second fluid pressure chambers.

BRIEF DESCRIPTION OF THE DRAWINGS

FIGS. 24A to 24C show a modification of a swing fulcrum pin for supporting a cam ring in the first to fourth embodiments described above, in which FIG. 24A is an enlarged sectional view of a support structure for the swing fulcrum pin as an exaggeration over the actual structure, and FIGS.

Figure 24A:
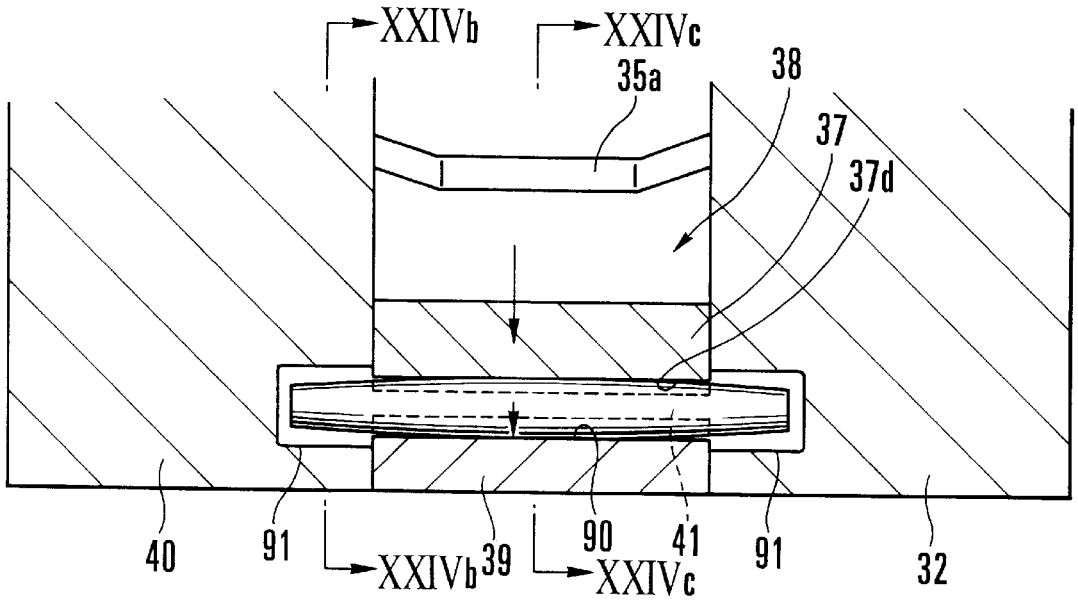
Figure 25:
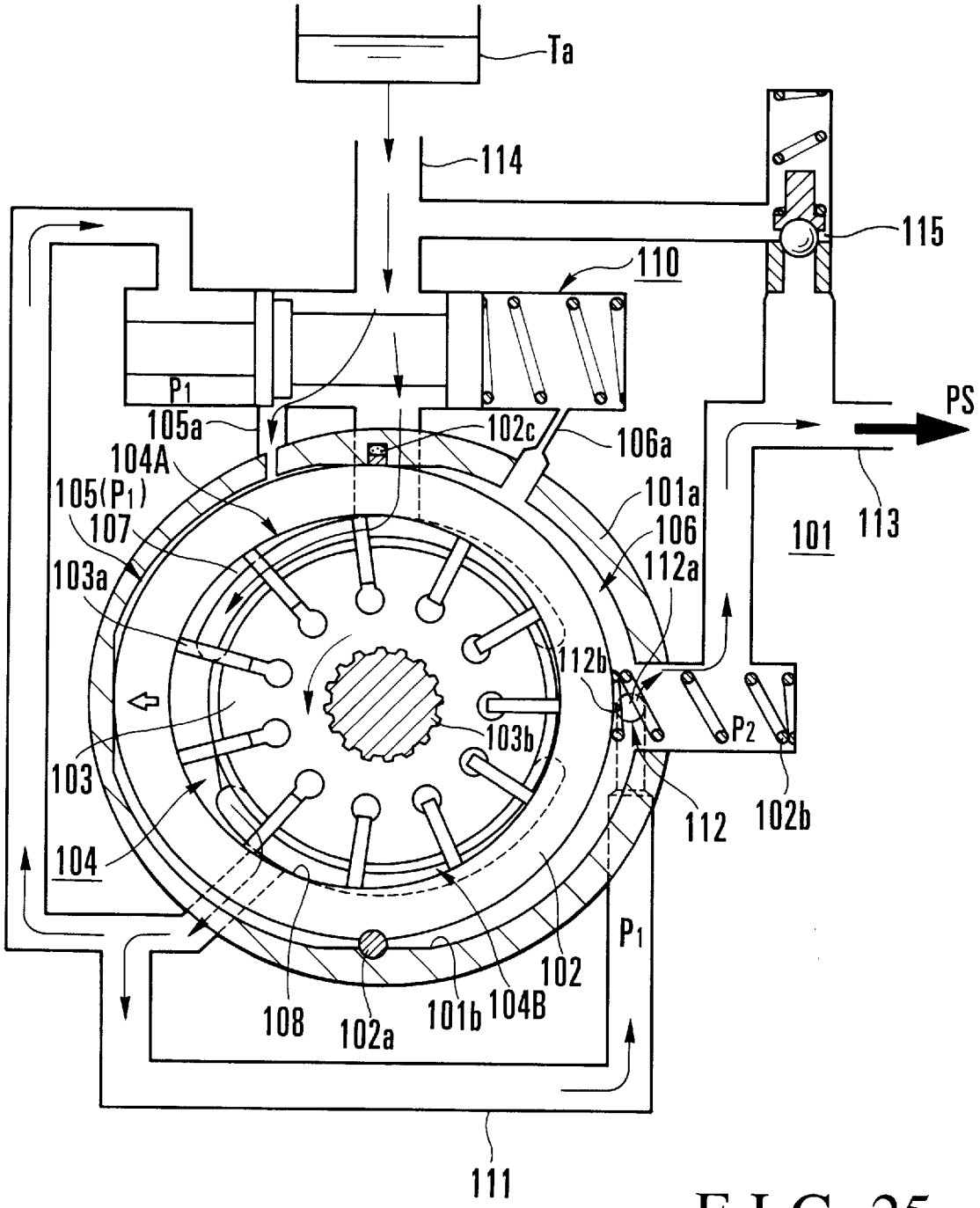
F I G. 25 PRIOR ART
Figure 26:
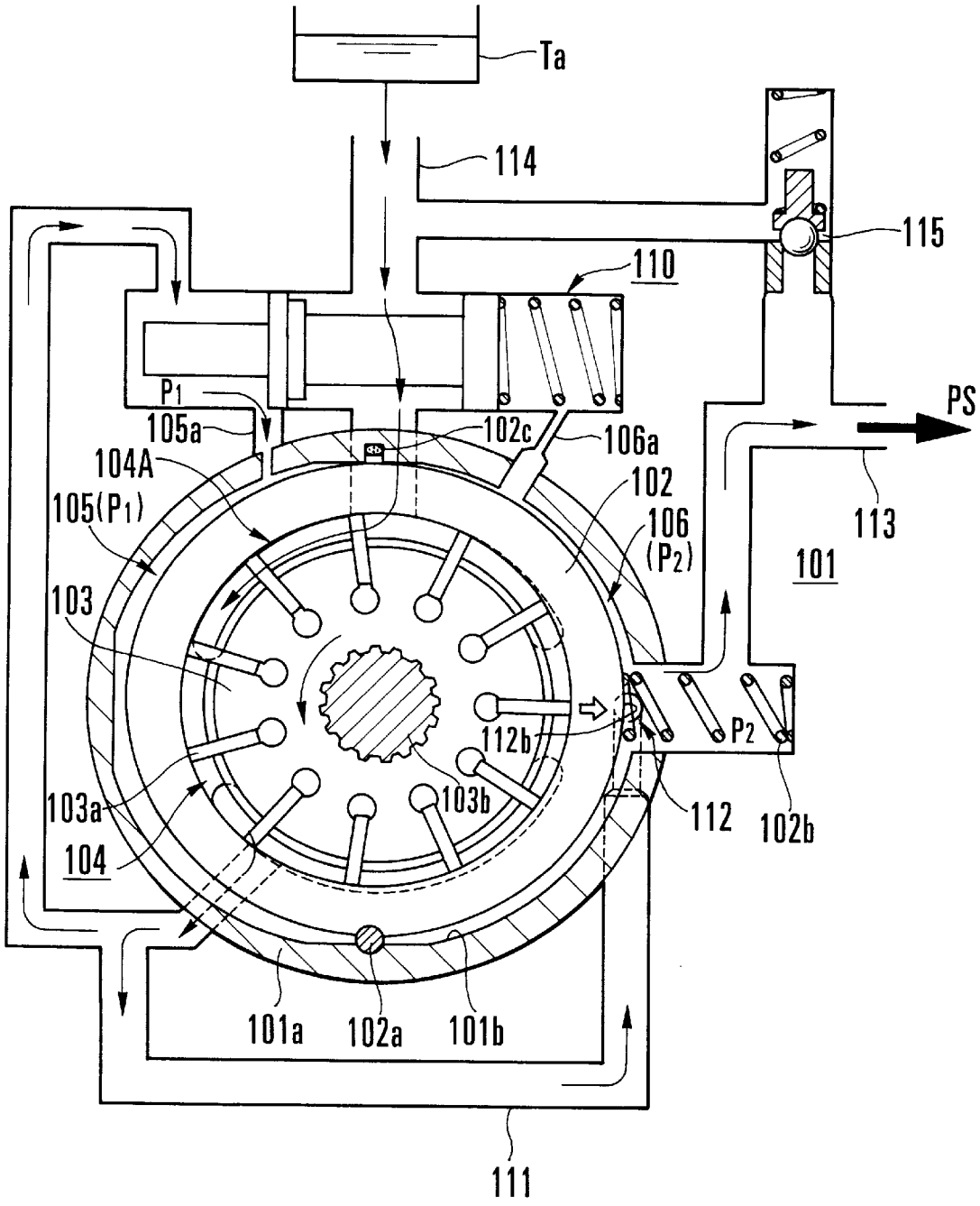
F I G. 26 PRIOR ART
Figure 27:
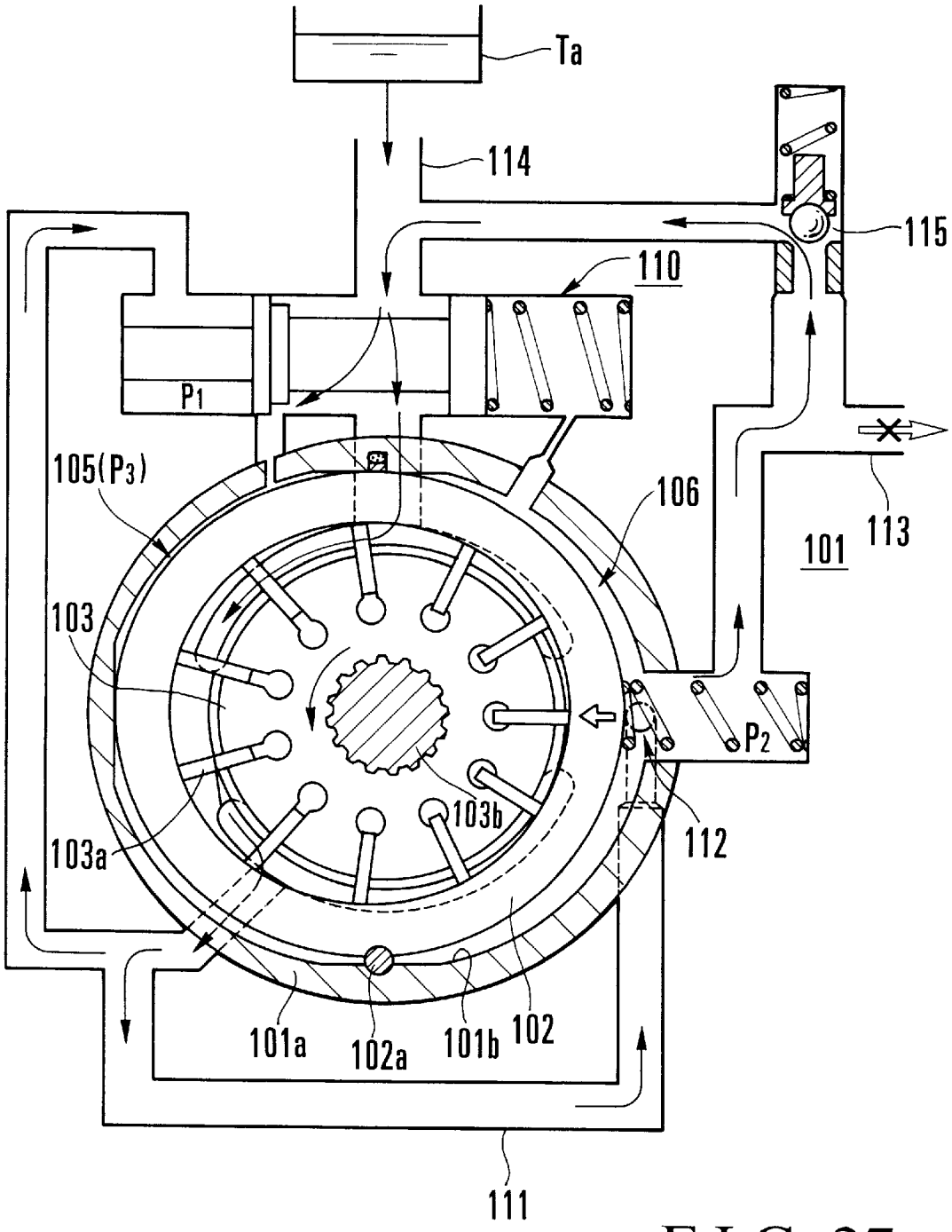
FIG. 27 PRIOR ART
Figure 28:
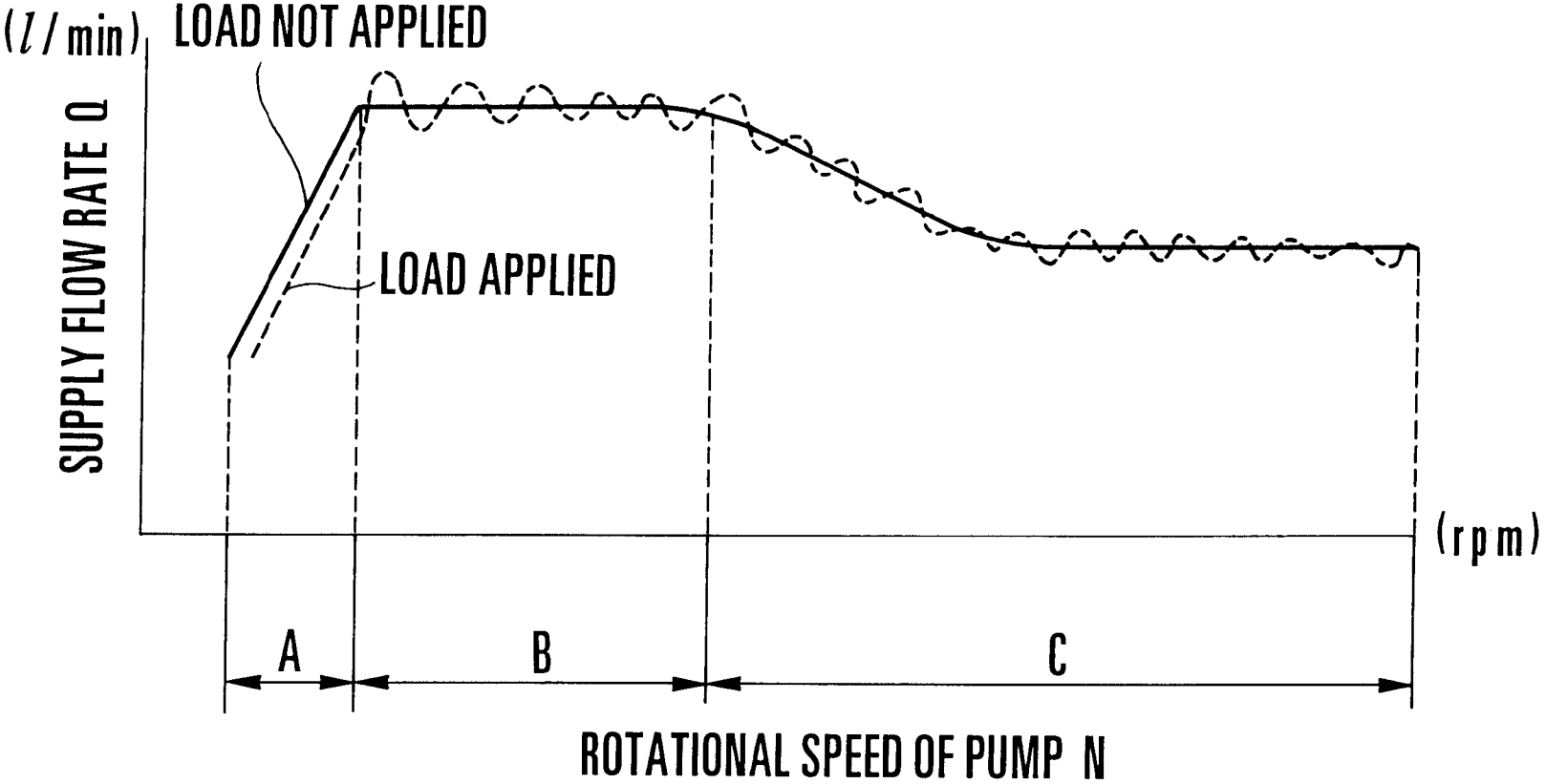

24B and 24C are sectional views taken along the lines XXIVb—XXIVb and XXIVc—XXIVc, respectively, of FIG. 24A;

FIG. 25 is a view showing a conventional variable displacement pump to explain a state during low-speed rotation;

FIG. 26 is a view for explaining a state during high-speed rotation of the variable displacement pump shown in FIG. 25;

FIG. 27 is a view for explaining a relief state during low-speed rotation of the variable displacement pump shown in FIG. 25; and FIG. 28 is a graph explaining the supply flow rate as a function of the pump rotational speed of the pump shown in FIG. 25.

DESCRIPTION OF THE PREFERRED EMBODIMENTS

FIGS. 1 to 9 show a variable displacement pump according to the first embodiment of the present invention.

Figure 7:
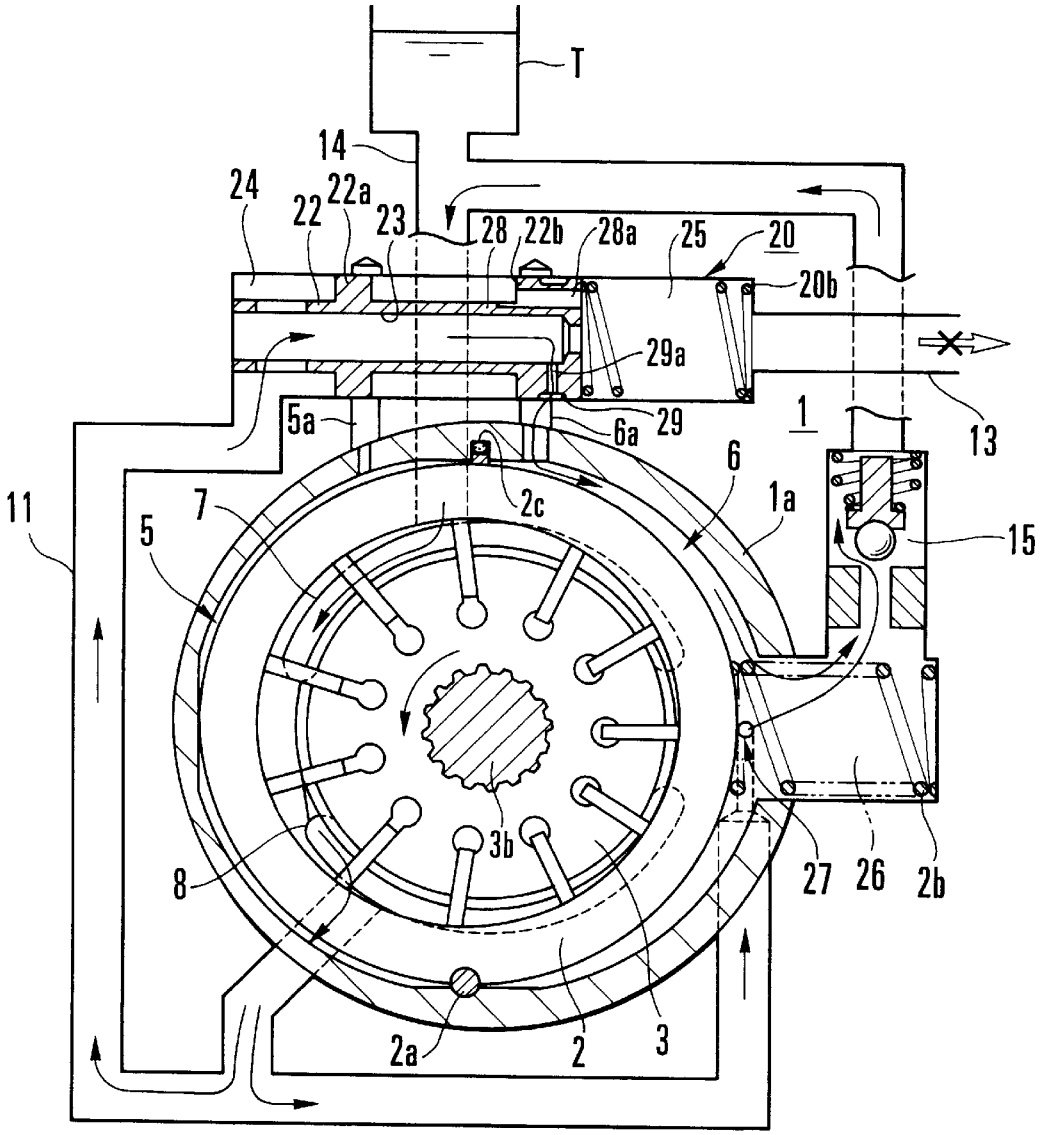
FIG. 7 is a view for explaining a relief state during low-speed rotation (immediately before a–b of FIG. 4) in FIG. 1.
Figure 8:
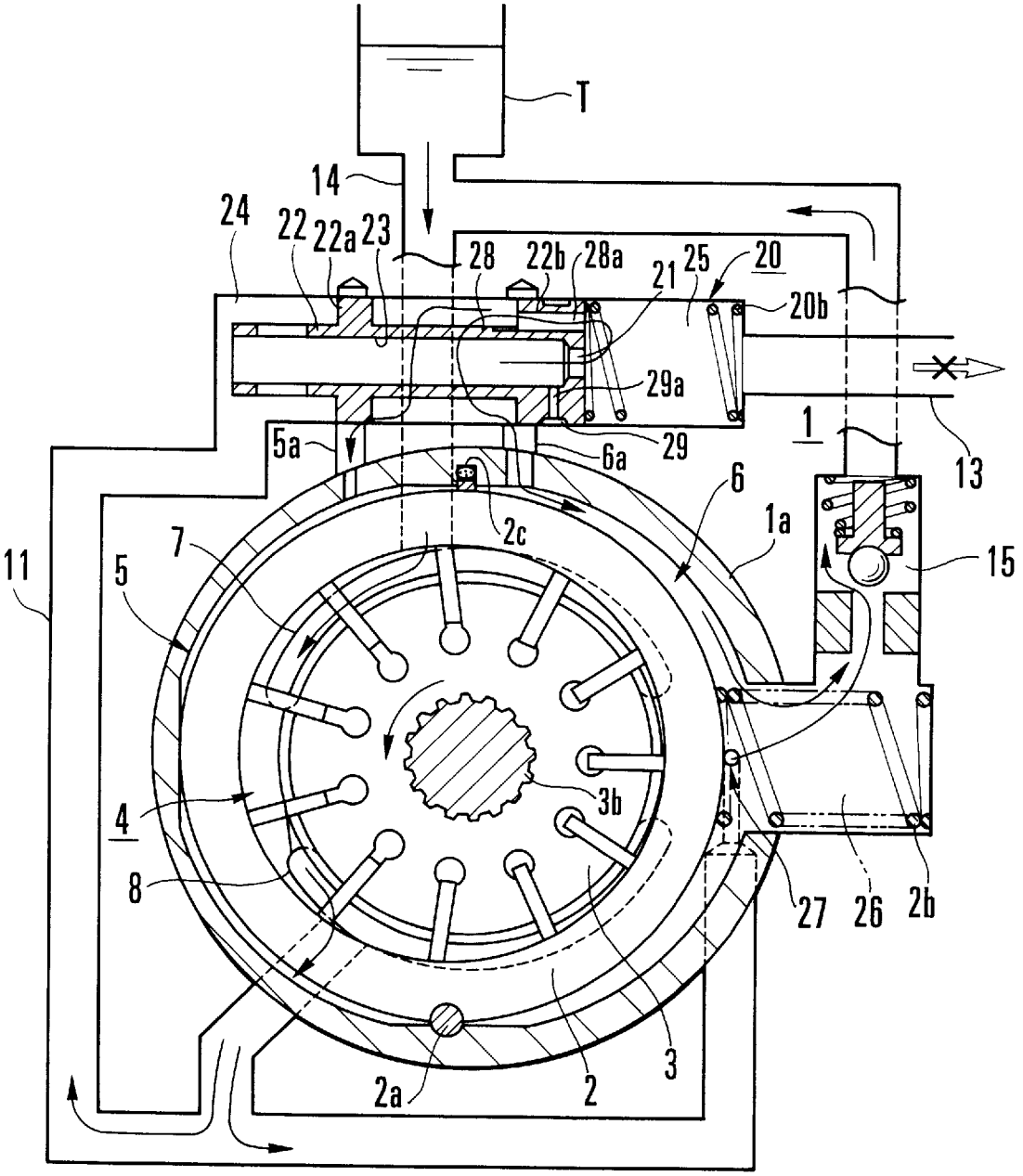
FIG. 8 is a view for explaining a relief state during medium-speed rotation (b of FIG. 4) in FIG. 2.
Figure 9:
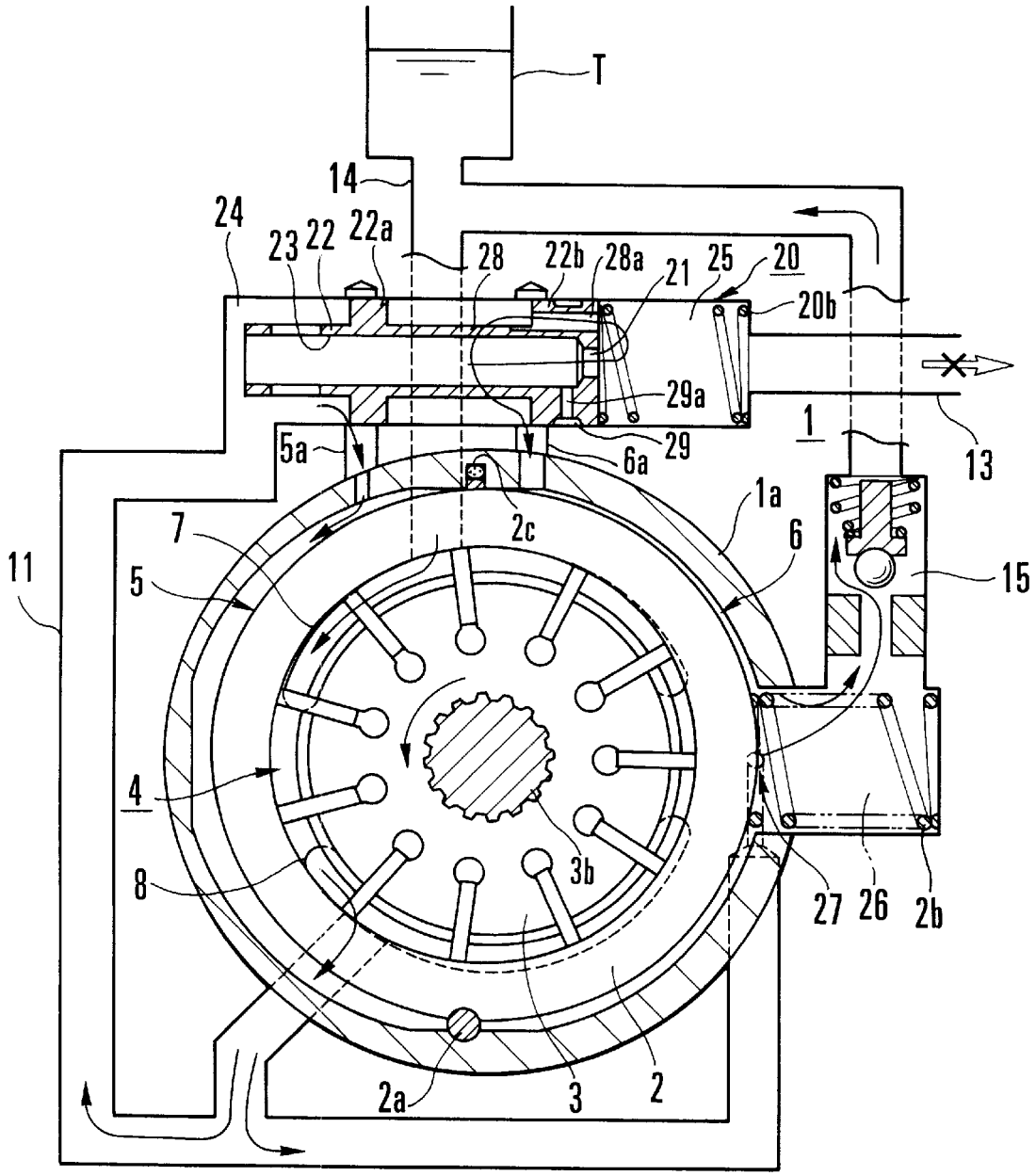
FIG. 9 is a view for explaining a relief state during high-speed rotation (b–e of FIG. 4) in FIG. 3.

The first embodiment exemplifies a case wherein a vane pump according to the present invention is a vane type oil pump serving as the oil pressure generating source of a power steering device, and has so-called drooping characteristics. According to the drooping characteristics, as the rotational speed of the pump increases, the discharge flow rate from the pump decreases to a predetermined value lower than the maximum discharge flow rate, and is maintained at this predetermined value. In this embodiment, the pump has a pilot type relief valve, as shown in FIGS. 7 to 9.

According to the present invention, as shown in FIGS. 1 to 3 and FIGS. 7 to 9, the pump has first and second fluid pressure chambers 5 and 6 and a control valve 20. The first and second fluid pressure chambers 5 and 6 are divisionally formed between the internal space (in this case, on an inner surface 1*b* of an adapter ring 1*a*) of the pump body and the outer surface of a cam ring 2 through a seal means (a swing fulcrum pin 2*a* and a seal member 2*c*) to swing the cam ring 2. The control valve 20 is actuated by the fluid pressures present upstream and downstream of a stationary metering restrictor 21, formed midway along a discharge path 11 for a pressure fluid discharged from a pump chamber 4, to control swing of the cam ring 2.

The control valve 20 is driven by the fluid pressures present upstream and downstream of the stationary metering restrictor 21, to exclusively connect each of the first and second fluid pressure chambers 5 and 6 to either the discharge path 11 or a discharge path 13 formed upstream or downstream of the stationary metering restrictor 21, and to switch connection of the first and second fluid pressure chambers 5 and 6.

According to the characteristic feature of the present invention, the fluid pressures present upstream and downstream of the stationary metering restrictor 21 are introduced to the first and second fluid pressure chambers 5 and 6 by the control valve 20 in the entire rotational speed range of the pump.

In this embodiment, a path hole 23 is formed in the spool type control valve 20 to extend along the axial direction of a spool 22, and the stationary metering restrictor 21 is formed in part of the path hole 23. The pump discharge path 11 is connected to one chamber (the left chamber in FIG. 1 and the like) 24 of a valve hole 20*a* constituting the control valve 20, and the pump discharge path 13 is connected to the other chamber (the right chamber in FIG. 1 and the like) 25 thereof. The pressure fluid is supplied to the pressure fluid utilizing equipment (e.g., PS) through the discharge path 13.

Part of the pump discharge path 11 is divided by a path 11*a* to be connected to the second fluid pressure chamber 6 through a variable metering restrictor 27 formed of a small hole 27*a* and a side edge 27*b* of the cam ring 2. The small hole 27*a* opens to a spring chamber 26 where a spring 2*b*, which biases the cam ring 2 in a direction to maximize the volume of the pump chamber 4, is arranged. The second fluid pressure chamber 6 is connected to a pilot type relief valve 15 through the spring chamber 26 to relieve the internal fluid pressure to a tank T.

Figure 1:
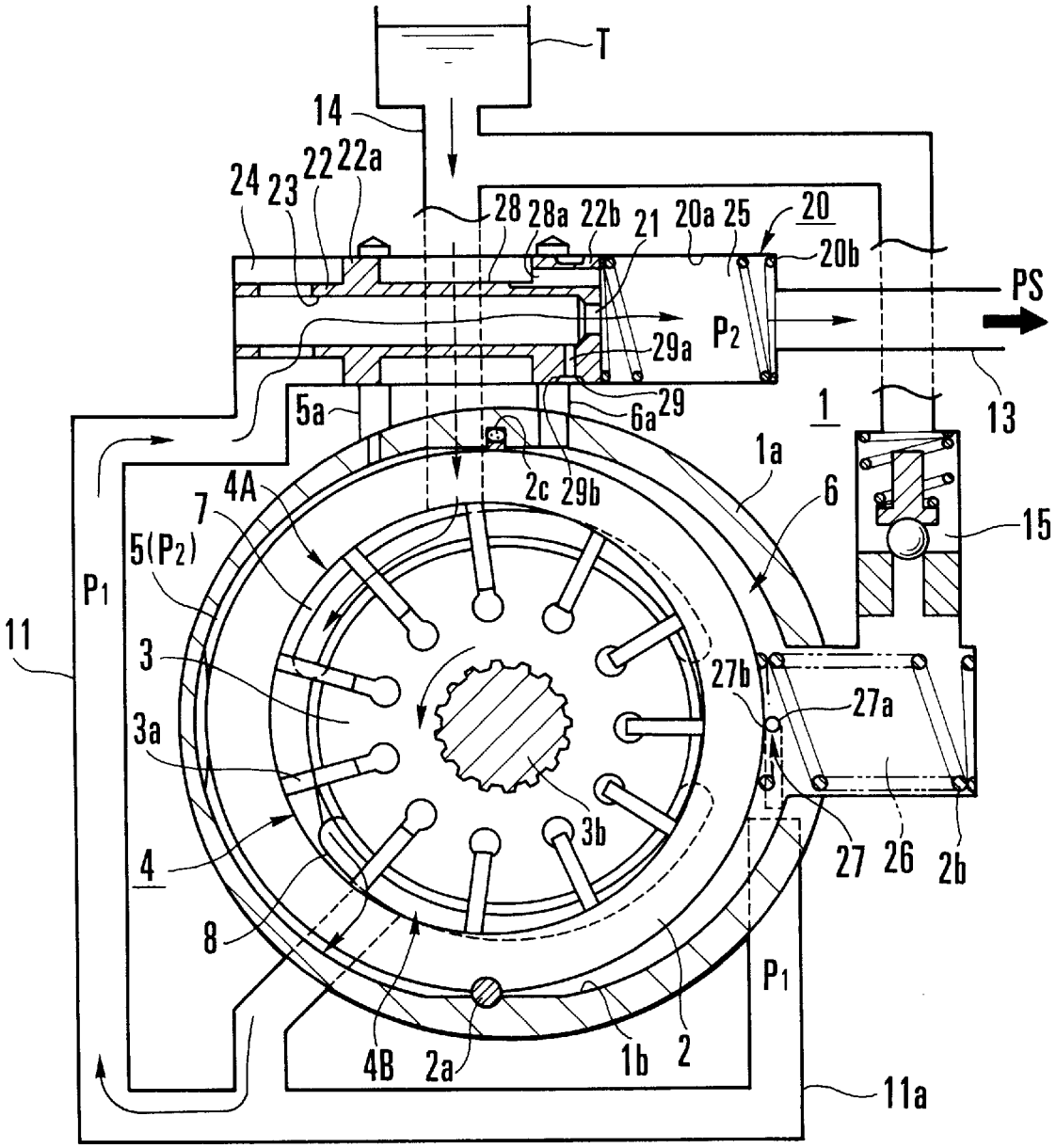
FIG. 1 is a view showing a variable displacement pump according to the first embodiment of the present invention to explain a state during low-speed rotation (immediately before a–b of FIG. 4)
Figure 6:
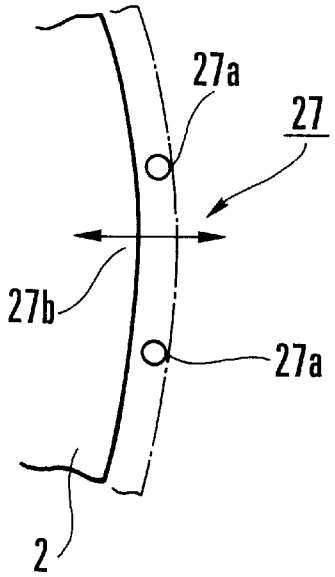
FIG. 6 is a view for explaining a modification of the hole in the pump shown in FIGS. 1 to 3, which is opened and closed by the side edge of a cam ring so as to serve as a variable metering restrictor.

The opening amount of the variable metering restrictor 27 is smaller than that of a conventionally known variable restrictor. The variable metering restrictor 27 need not be formed of one small hole 27*a* described above which is opened/closed by the side edge 27*b* of the cam ring 2, as shown in FIG. 1 and the like, but can be formed of two or more small holes 27*a*, as shown in FIG. 6. The swing amount of the cam ring 2 is, for example, about 1.9 mm in an existing product. If a plurality of small holes 27*a* (the total opening amount is equal to that of the variable metering restrictor 27 formed of one small hole 27*a*) are formed, the restrictor can be opened/closed by a small displacement of the cam ring 2. This is convenient in setting the pump performance.

Obviously, the small hole 27*a* is not limited to a circular one.

The second fluid pressure chamber 6 opens to part of the valve hole 20*a* through a path 6*a*. A path 5*a* connected to the first fluid pressure chamber 5 also opens to part of the valve hole 20*a* at a position shifted from the path 6*a* in the axial direction.

A spring 20*b* biases the spool 22 to the left in FIG. 1.

The spool 22 has lands 22*a* and 22*b* for selectively opening/closing the paths 5*a* and 6*a*. The spool 22 also has an annular groove 28 where the fluid pressure obtained downstream of the stationary metering restrictor 21 is introduced through a path hole 28*a* formed in the land 22*b* in the axial direction. The annular groove 28 is selectively connected to the path 5*a* or 6*a* in accordance with the motion of the spool 22, to introduce the fluid pressure obtained downstream of the stationary metering restrictor 21 to the first or second fluid pressure chamber 5 or 6.

A plurality of path holes 28*a* may be formed as required so as not to form a choke.

An annular groove 29 to be selectively connected to the path 6*a* is formed in the outer surface of the land 22*b* of the spool 22. The annular groove 29 is connected to a path 23 formed upstream of the stationary metering restrictor 21 through a path hole 29*a* formed radially in the spool 22. Therefore, in the pump of this embodiment, the stationary metering restrictor 21 is provided to the pump discharge path system (11, 11*a*, 23, and 13), and the variable metering restrictor 27 opened/closed in accordance with the swing motion of the spool 22 is added. The drooping characteristics described above are obtained by the motion of the variable metering restrictor 27.

Figure 5:
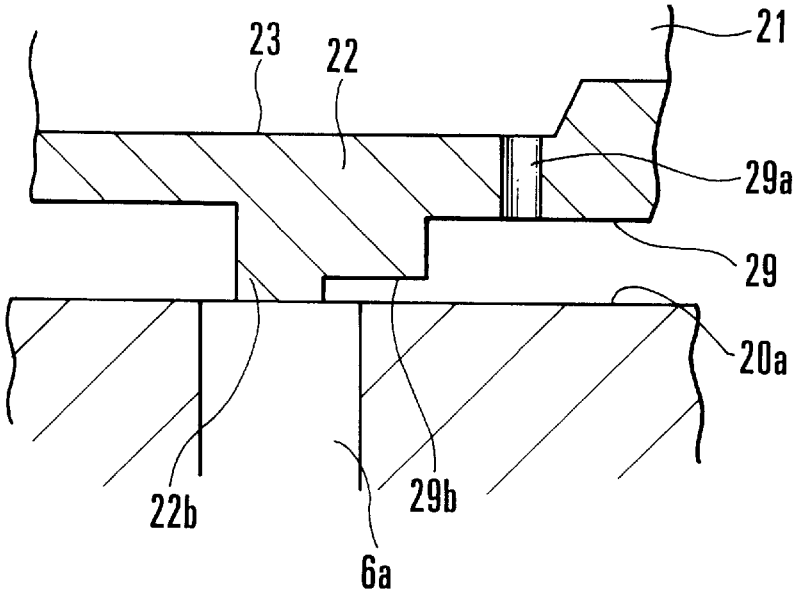
FIG. 5 is an enlarged view of the main part of the control valve of the pump shown in FIGS. 1 to 3 to show the relationship between the lands of the spring chamber of the spool and a path that opens to a valve hole.

A chamfer 29*b* is formed between the path 6*a* and annular groove 29, as shown in FIG. 5. The chamfer 29*b* serves as a damper restrictor for braking the motion (e.g., damping) of the cam ring 2. The path hole 29*a* serves as a pilot restrictor in a path comprised of the path 11*a* serving as the pilot path, the variable metering restrictor 27, the second fluid pressure chamber 6, and the like.

In the control valve 20 described above, pressure differences generated by the metering restrictor 27 act on the chambers 24 and 25 on the front and rear ends of the spool 22. For example, when the pump rotates at a low speed, differential pressures generated by the restrictor composed of the stationary and variable metering restrictors 21 and 27 act. When the pump rotates at a high speed, differential pressures generated by the stationary metering restrictor 21 act on the chambers 24 and 25.

The spool 22 moves in accordance with the differential pressures, so either one of the fluid pressures upstream and downstream of the metering restrictors 21 and 27 in the pump discharge paths 11, 11*a,* and 13 acts on the first and second fluid pressure chambers 5 and 6.

More specifically, in the control valve 20, when the pump rotates at a low speed, the downstream and upstream sides of the stationary metering restrictor 21 are connected to the first and second fluid pressure chambers 5 and 6, respectively. When the pump rotates at a high speed, the upstream and downstream sides of the stationary metering restrictor 21 are connected to the first and second fluid pressure chambers 5 and 6, respectively.

Figure 3:
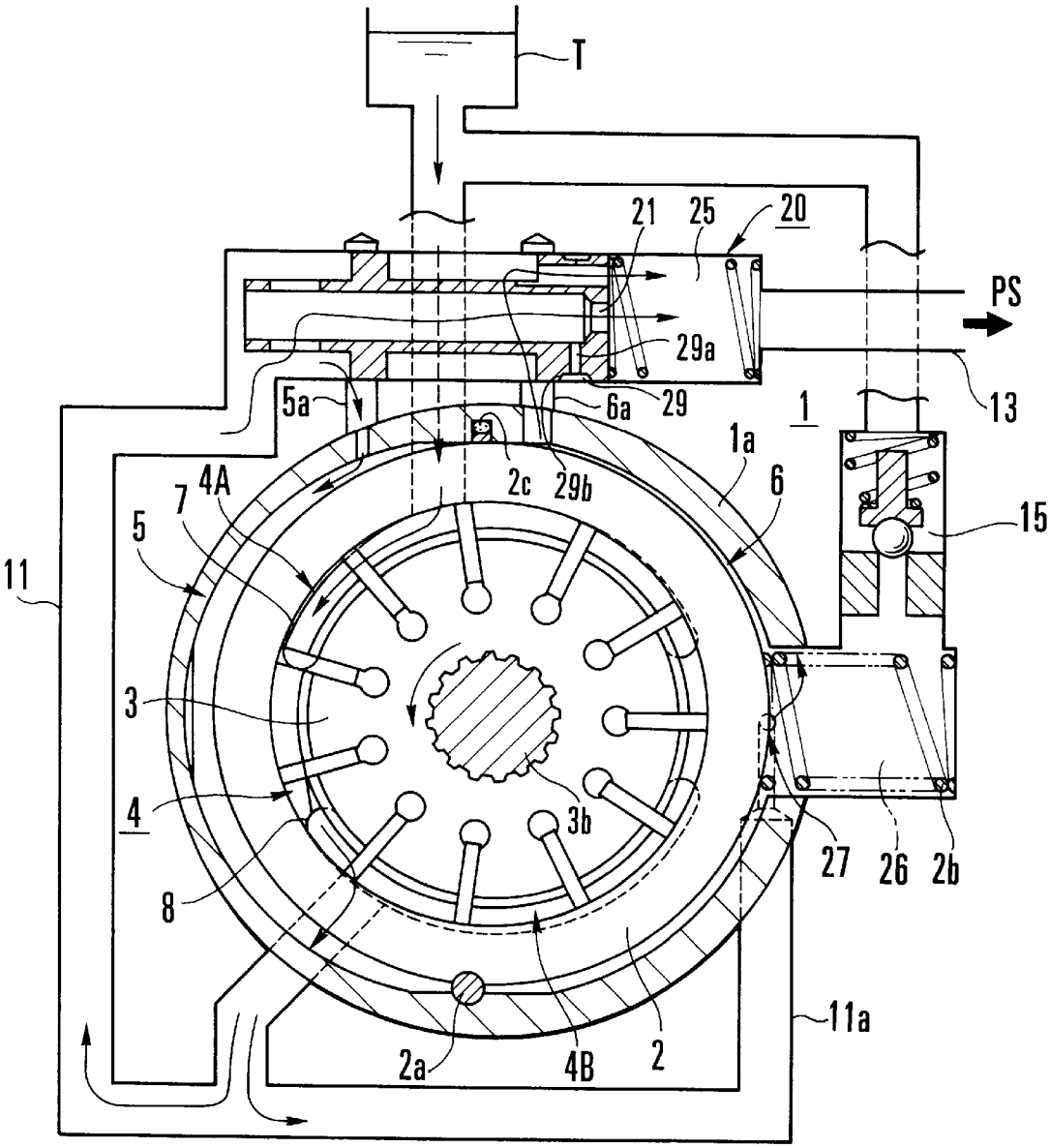
FIG. 3 is a view for explaining a state during high-speed rotation (b–e of FIG. 4) of the variable displacement pump shown in FIG. 1.
Figure 4:
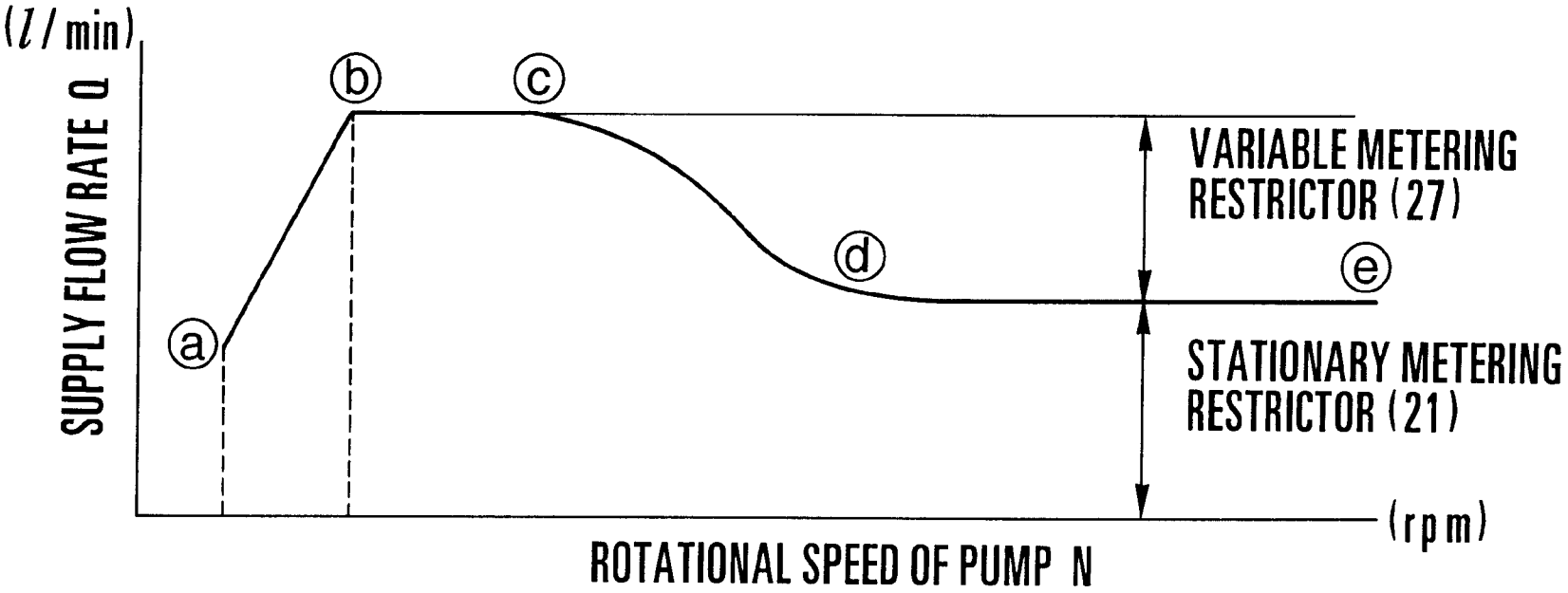
FIG. 4 is a graph explaining the supply flow rate as a function of the pump rotational speed of the pump shown in FIGS. 1 to 3.

FIG. 4 shows the supply flow rate as a function of the pump rotational speed of the variable displacement pump according to the present invention. FIG. 1 described above shows a state until immediately before a–b in FIG. 4, FIG. 2 shows a state of b in FIG. 4, and FIG. 3 shows a state of b–e in FIG. 4.

Figure 2:
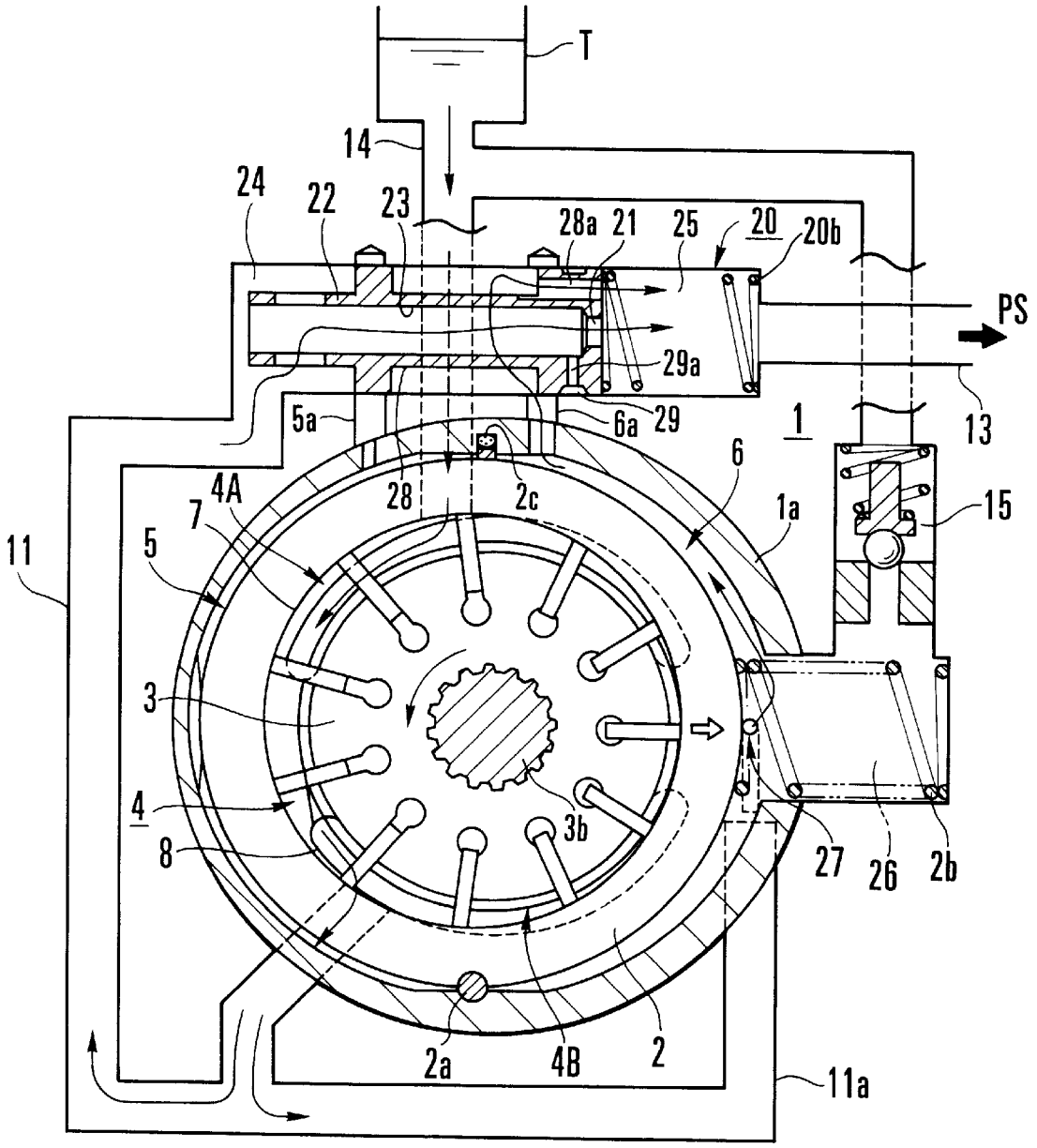
FIG. 2 is a view for explaining a state during medium-speed rotation (b of FIG. 4) of the variable displacement pump shown in FIG. 1.

Referring to FIGS. 1 to 3 described above, the opening amount of the variable metering restrictor 27 decreases gradually, and the supply flow rate from the pump decreases accordingly. When the variable metering restrictor 27 is closed, the supply flow rate from the pump reaches a constant value smaller than the maximum flow rate due to the operation of only the stationary metering restrictor 21.

For example, the pressure fluid discharged from the pump chamber 4 is supplied to the pressure fluid utilizing equipment PS through the pump discharge paths 11 and 11*a,* and the metering restrictors 21 and 27. When the pump rotates at a low speed, the cam ring 2 is located at a position to maximize the volume of the pump chamber 4, as shown in FIGS. 1 and 2. This is because the fluid pressure in the pump discharge paths 11 and 11*a* which is obtained upstream of the stationary metering restrictor 21 is introduced to the second fluid pressure chamber 6, and the fluid pressure in the pump discharge paths 11, 11*a,* and 13 which is obtained downstream of the stationary metering restrictor 21 is introduced to the first fluid pressure chamber 5.

Assume that the rotational speed of the pump increases, that the flow rate of the pressure fluid from the pump chamber 4 increases, and that the spool 22 of the spool type control valve 20 is urged by the fluid pressure obtained in the pump discharge path 11 upstream of the stationary metering restrictor 21 to move as shown in FIG. 3. The fluid pressure obtained upstream of the stationary metering restrictor 21 is introduced to the first fluid pressure chamber 5, and the fluid pressure obtained downstream of the stationary metering restrictor 21 is introduced to the second fluid pressure chamber 6 through the annular groove 28 of the spool 22, in an opposite manner to that during low-speed rotation of the pump described above. The cam ring 2 swings clockwise in FIGS. 1 and 2 due to the pressure difference between the fluid pressures obtained upstream and downstream of the stationary metering restrictor 21, to reduce the volume of the pump chamber 4, thereby decreasing the discharge flow rate from the pump chamber 4.

According to this variable displacement pump, the supply flow rate from the pump rises to a predetermined value in a low rotational speed range, as shown in FIG. 4. After that, this value is maintained. When the rotational speed of the pump becomes higher than a predetermined value, the differential pressures generated by the variable metering restrictor 27 disappears, the supply flow rate from the pump becomes equal to or lower than the predetermined value described above, and is maintained at this value.

In the variable displacement pump described above, when a load is applied to the pump by, e.g., actuation of the pressure fluid utilizing equipment PS that receives the fluid pressure from this pump, the fluid pressure in the pump discharge path 11 increases, and the fluid pressure in the low-pressure fluid pressure chamber 6, where the fluid pressure obtained downstream of the variable metering restrictor 27 is introduced, increases. When this pressure exceeds a preset value of the relief valve 15, this relief valve 15 is opened, as shown in FIGS. 7, 8, and 9, to relieve the pump discharge fluid to the pump suction side.

FIGS. 7 to 9 show a relief state corresponding to FIGS. 1 to 3 described above.

In this case, the fluid pressure in the discharge path 11 obtained upstream or downstream of the stationary metering restrictor 21 is introduced to the first fluid pressure chamber 5. The fluid pressure obtained downstream or upstream of the stationary metering restrictor 21 is introduced to the second fluid pressure chamber 6. When the latter pressure becomes equal to a predetermined value or more, the relief valve 15 is opened to set the relief state, so the pressure of the second fluid pressure chamber 6 becomes lower than that of the first fluid pressure chamber 5.

The cam ring 2 swings due to the fluid pressure in the first fluid pressure chamber 5 and the biasing force of the spring 2*b* in a direction to reduce the volume of the pump chamber 4, to maintain the discharge flow rate from the pump chamber 4 to a predetermined value or less. The pump driving force becomes the minimum.

With the structure described above, the introduced fluid pressures in the first and second fluid pressure chambers 5 and 6 for swinging the cam ring 2 are the fluid pressures present upstream and downstream of either the metering restrictor 21 or 27. Thus, the pressure difference between the first and second fluid pressure chambers 5 and 6 is small. The fluid pressure difference between the discharge region of the pump chamber 4 and the first fluid pressure chamber 5 also decreases. The fluid pressures present upstream and downstream of the stationary metering restrictor 21 of the pump discharge path 23 are supplied even to the inner path or the two ends of the spool 22 in the control valve 20, to decrease the pressure difference.

Accordingly, an internal leakage at these portions is reduced.

With the control valve 20 described above, when the pump rotates at a low speed, the pressures obtained downstream and upstream of the stationary metering restrictor 21 can be introduced to the first and second fluid pressure chambers 5 and 6, respectively. Inversely, when the pump rotates at a high speed, the pressures obtained upstream and downstream of the stationary metering restrictor 21 can be introduced to the first and second fluid pressure chambers 5 and 6, respectively. Therefore, during the return motion wherein the pump speed shifts from high rotational speed to low rotational speed, the cam ring 2 can swing smoothly.

Figure 10:
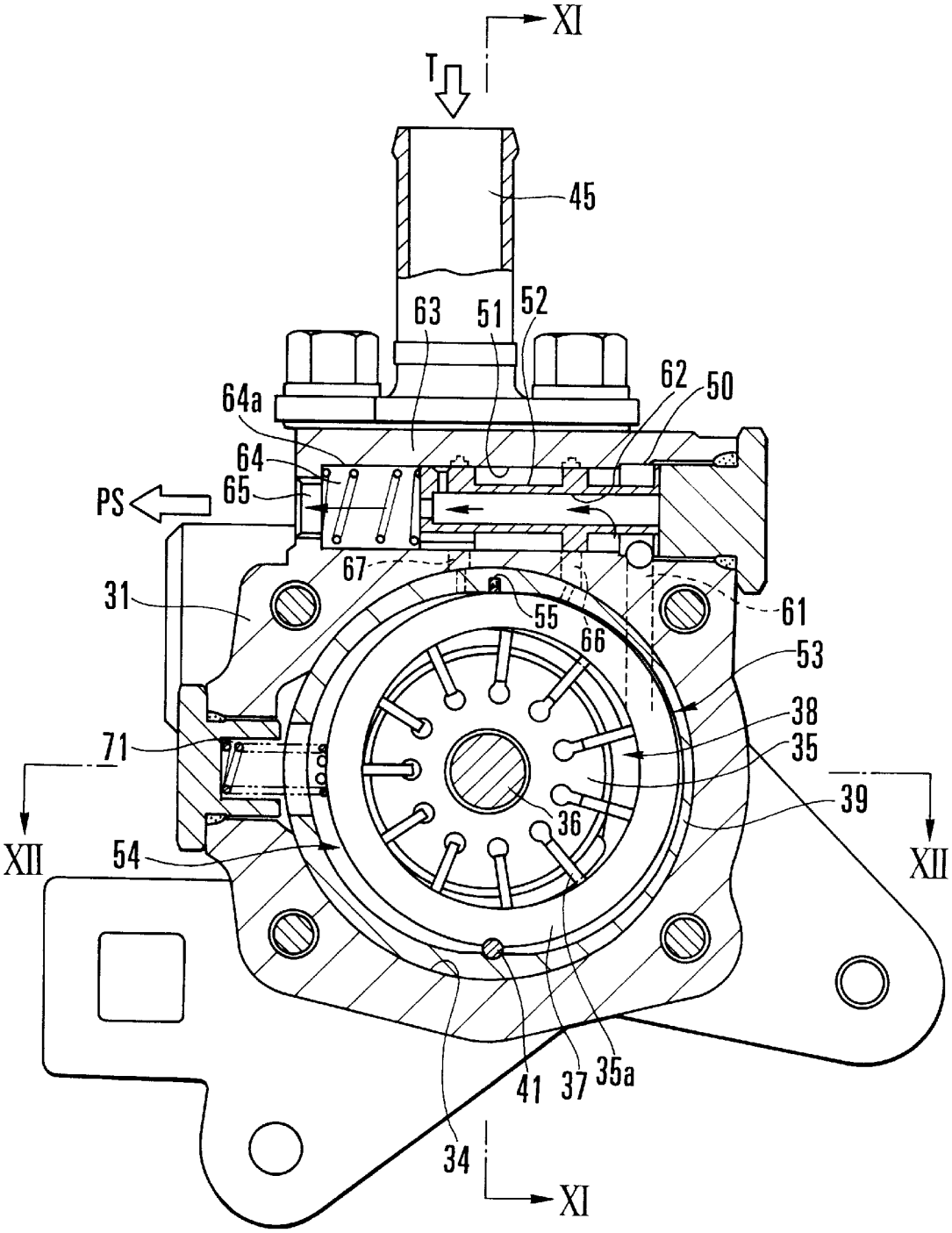
FIG. 10 is a sectional view of a pump to show a practical example of the variable displacement pump shown in FIGS. 1 to 3 and FIGS. 7 to 9.
Figure 11:
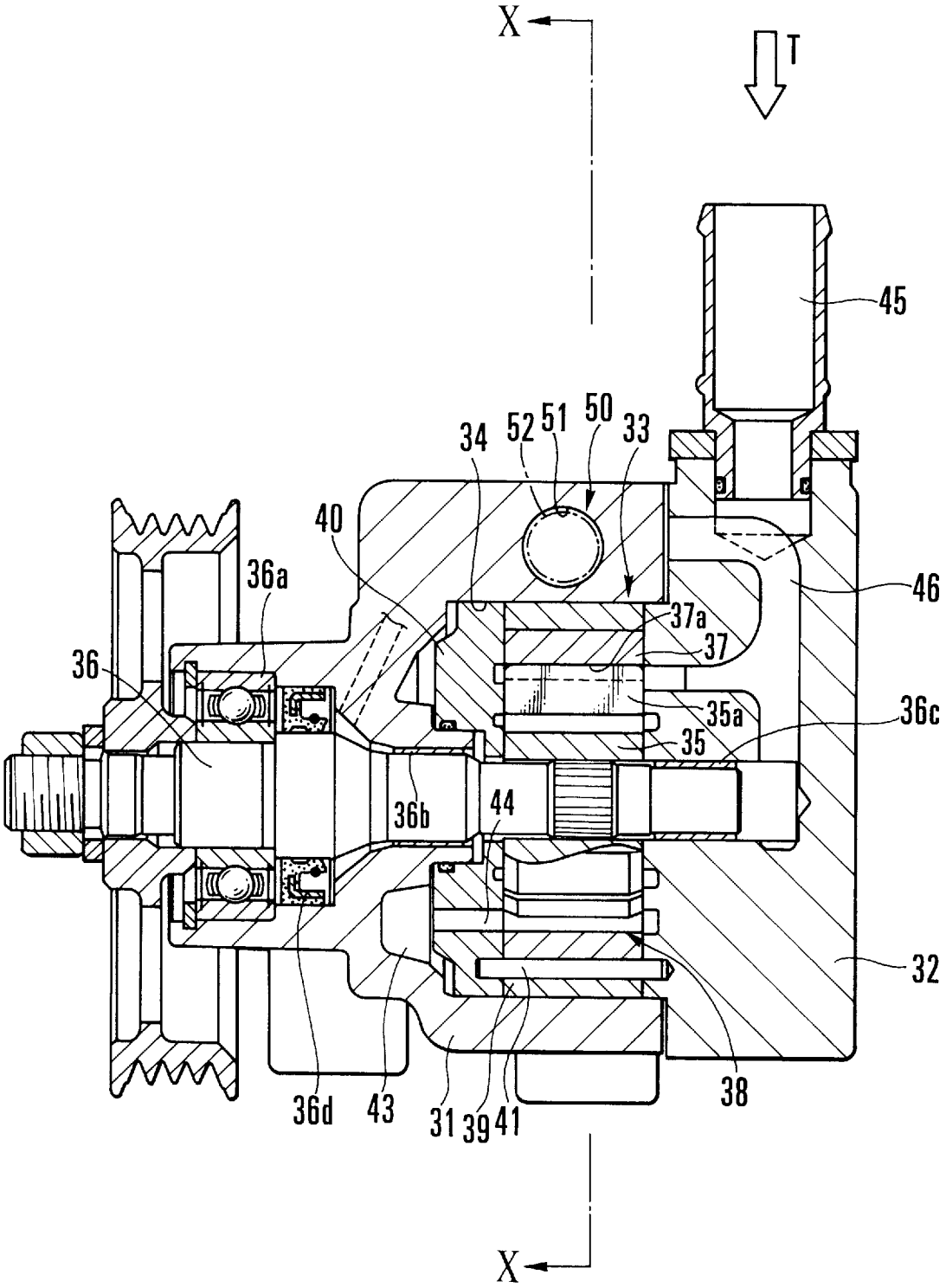
FIG. 11 is a sectional view taken along the line XI—XI of FIG. 10.
Figure 12:
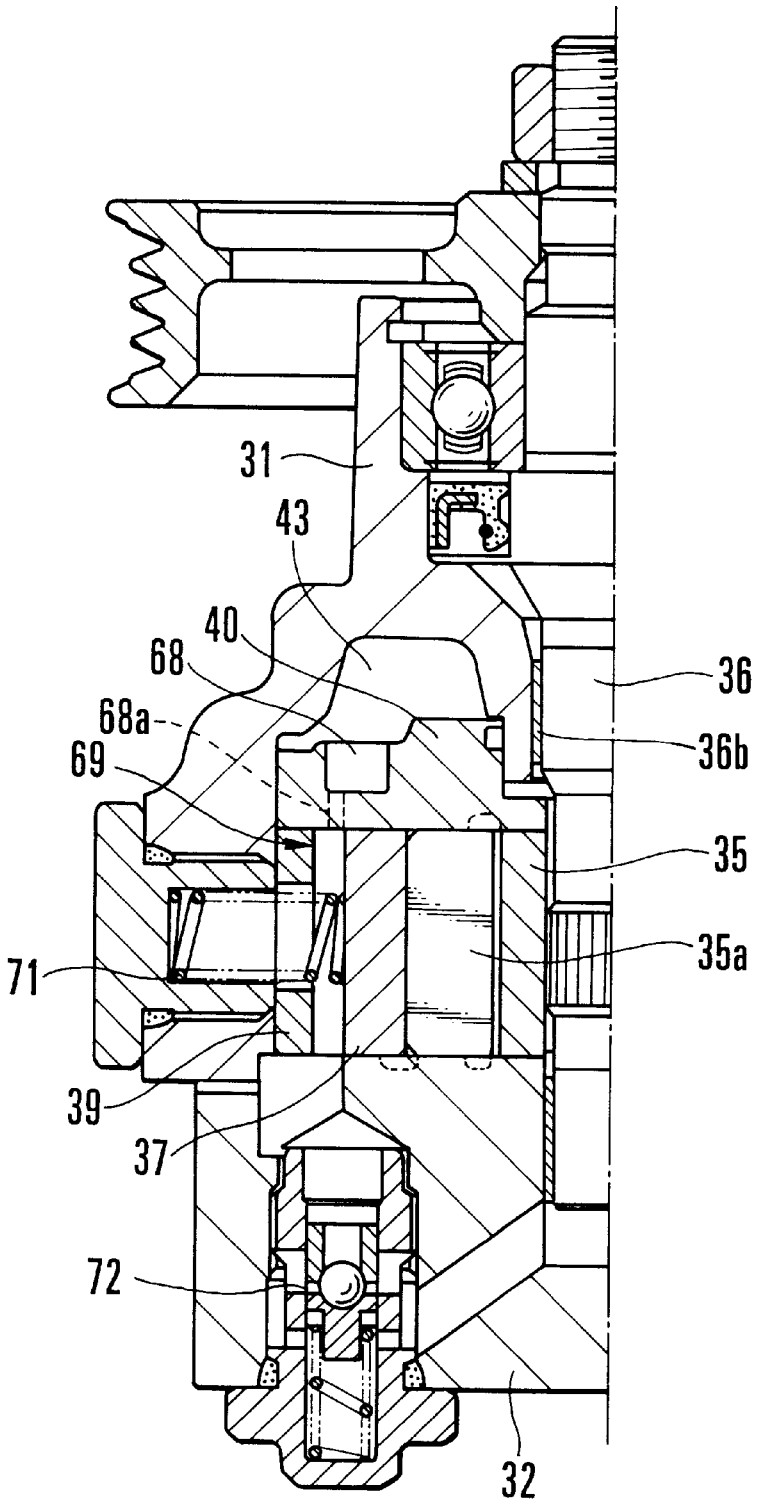
FIG. 12 is a sectional view taken along the line XII—XII of FIG. 10.

FIGS. 10, 11, and 12 show a practical example of the variable displacement pump according to the present invention which has been described with reference to FIGS. 1 to 3 and FIGS. 7 to 9.

Referring to FIGS. 10, 11, and 12, a vane type variable displacement pump denoted by reference numeral 30 has a front body 31 and a rear body 32 constituting a pump body. The entire portion of the front body 31 forms a substantially cup-like shape, as shown in FIG. 11. A housing space 34 for housing pump constituent elements 33 as a pump cartridge is formed in the front body 31. The rear body 32 is integrally combined with the front body 31 to close the opening end of the housing space 34. A driving shaft 36 for externally, rotatably driving a rotor 35 constituting the pump constituent elements 33 extends through the front body 31, and is rotatably supported by the front body 31 through bearings 36*a,* 36*b,* and 36*c* (the bearing 36*a* and 36*b* are disposed on the front body 32 while the bearing 36*c* is disposed on the rear body 32). Reference numeral 36*d* denotes an oil seal.

A cam ring 37 has an inner cam surface 37*a* fitted on the outer surface of the rotor 35 having vanes 35*a,* to form a pump chamber 38 between the inner cam surface 37*a* and rotor 35. The cam ring 37 is movably arranged in an adapter ring 39 that fits the inner wall portion of the housing space 34, to be able to change the volume of the pump chamber 38, as will be described later.

The adapter ring 39 serves to hold the cam ring 37 in the housing space 34 of the front body 31 to be movable.

A pressure plate 40 is stacked on the front body 31 of the pump cartridge (pump constituent elements 33), constituted by the rotor 35, cam ring 37, and adapter ring 39 described above, to press against it. The end face of the rear body 32 is pressed against the opposite side surface of the pump cartridge as a side plate. When the front body 31 and rear body 32 are integrally assembled, the pump cartridge is assembled in a required state. These members construct the pump constituent elements 33.

The pressure plate 40 and the rear body 32 stacked on it through the cam ring 37 to serve as the side plate are integrally assembled and fixed to each other while they are positioned in the rotational direction by a swing fulcrum pin 41 (to be described later) and by an appropriate rotation preventive means (not shown). The swing fulcrum pin 41 also serves as a positioning pin and an axial support portion for swinging the cam ring 37, and has a seal function to define a fluid pressure chamber where the cam ring 37 swings.

A pump discharge pressure chamber 43 is formed in the housing space 34 of the front body 31 on the bottom portion side. The pump discharge pressure chamber 43 exerts the pump discharge pressure on the pressure plate 40. A pump discharge path 44 is formed in the pressure plate 40 to guide the hydraulic oil from the pump chamber 38 to the pump discharge pressure chamber 43.

A pump suction port 45 is formed in part of the rear body 32. A suction fluid entering from a tank T through the port 45 flows through a pump suction path 46 formed in the rear body 32, and is supplied into the pump chamber 38 through a pump suction opening formed in the end face of the rear body 32.

A control valve 50 is composed of a spool 52 and a valve hole 51 formed in the upper portion of the front body 31 in a direction perpendicular to the driving shaft 36. The control valve 50 controls the fluid pressures to be introduced into first and second fluid pressure chambers 53 and 54, divisionally formed on two sides of the cam ring 37 in the adapter ring 39 by the swing fulcrum pin 41 and a seal member 55 axially symmetric to it.

A path 61 is connected to the pump discharge pressure chamber 43 to open to one end of the valve hole 51. A path 62 is formed in the spool 52 in the axial direction. A stationary metering restrictor 63 is formed in part of the path 62, on a side of a spring chamber 64 having a spring 64*a* formed on the other end of the spool 52. A pump discharge port 65 is formed on the outer end of the spring chamber 64 to supply a pressure to a hydraulic equipment PS such as a power steering device (not shown).

As described above, the spool 52 introduces the fluid pressures present upstream and downstream of the stationary metering restrictor 63 to the first and second fluid pressure chambers 53 and 54 through paths 66 and 67 in accordance with the rotational speed of the pump.

Part of the pump discharge path, in this embodiment, an opening end 68*a* of a path 68 formed in the pressure plate 40 and the circumferential edge of the cam ring 37, forms a variable metering restrictor 69.

A spring 71 biases the cam ring 37, and a relief valve 72 is provided in part of the rear body 32.

In FIGS. 10 to 12, the practical structure and operation of the control valve 50 are identical to those described above with reference to FIG. 1 and the like, and a detailed description thereof will be omitted.

Of the vane type variable displacement pump 30 described above, its arrangement other than those described above is conventionally widely known, and a detailed description thereof will be omitted.

The variable displacement pump 30 having the above arrangement operates in the manner described above with reference to FIGS. 1 to 3 and FIGS. 7 to 9, and a detailed description thereof will be omitted.

In this variable displacement pump 30, the biasing force of the spring 71 for biasing the cam ring 37 is set to be larger than a force with which a fluid pressure in the pump discharge region on the inner surface of the cam ring 37, where the pump discharge pressure in the pump chamber 38 acts, balances in the rotational direction of the rotor 35 by an amount for absorbing a manufacturing error. According to this arrangement, in the region on the inner surface of the cam ring 37 where the pump discharge fluid pressure acts, the forces on the right and left sides of the swing fulcrum pin 41 of the cam ring 37 are balanced, so that the cam ring 37 swings appropriately.

In the variable displacement pump 30, the pump discharge region having the pump discharge opening in the pump chamber 38 formed between the rotor 35 and the cam ring 37 generally has an angle difference in the ranges corresponding to the left and right fluid pressure chambers (first and second fluid pressure chambers) formed on the two sides of the cam ring 37 centered on the support pin 41 serving as the swing fulcrum pin of the cam ring. The pump discharge region generally has a larger range corresponding to the second fluid pressure chamber side serving as the low pressure side. As a result, the unbalanced force always acts such that the pump dicharge pressure swings the cam ring 37 toward the second fluid pressure chamber by the above angle difference. To remove this unbalanced force, a force is preferably added to the biasing force of the spring for biasing the cam ring so as to cancel the unbalanced force. In the pump structure described above, an unbalanced force based on the operation errors of the respective members described above is also present. Therefore, all these unbalanced forces must be canceled at once.

More specifically, due to manufacturing errors such as an angular displacement or error in rotational direction of the pump suction and discharge openings in a surface in contact with the pressure plate 40 or the pump constituent elements 33 of the rear body 32, the positional precision of the swing fulcrum pin 41, the magnitude of the fluid pressure in the pump chamber 38, and the like, the forces generated on the right and left sides of the cam ring 37 may be unbalanced. These respects are considered in the present invention. A force that can absorb an unbalance, that should occur between the right and left sides of the cam ring 37, is set in advance as a biasing force having a magnitude given as the biasing force of the spring 71, so the appropriate swing motion of the cam ring 37 can be ensured.

In other words, the biasing force for biasing the cam ring is set in advance in consideration of the force for biasing to swing the cam ring to the initial position, the force for canceling the unbalance caused by the structural factor of the variable displacement pump (i.e., the discharge fluid pressure in the pump chamber, which acts in the swing direction of the cam ring, is unbalanced), and the force for canceling the manufacturing errors caused by the pump structural factors (i.e., the positional errors of the members associated with the swing of the cam ring, pump suction, and discharge-associated members).

Regarding the thrust (e.g., the product of the pressure on the opening of the control valve 20 and the area of the cam ring 37) generated by the control pressure of the control valve 20 to act on the cam ring 37, unbalanced forces and the biasing force of the spring 71 for biasing the cam ring 37 may be set at necessary minimum values, so that the cam ring 37 is operated with a pressure equal to or smaller than the difference between the pressures present upstream and downstream of the metering restrictors 21 and 27 described above.

FIGS. 13 to 16B show a variable displacement pump according to the second embodiment of the present invention. In FIGS. 13 to 16B, portions identical or corresponding to their counterparts in FIGS. 1 to 3 described above are denoted by the same reference numerals as in FIGS. 1 to 3, and a detailed description thereof will be omitted. The pump of the second embodiment is also a variable displacement pump having so-called drooping characteristics, with which as the rotational speed of the pump increases, the discharge flow rate from the pump becomes lower than the maximum flow rate.

Figure 13:
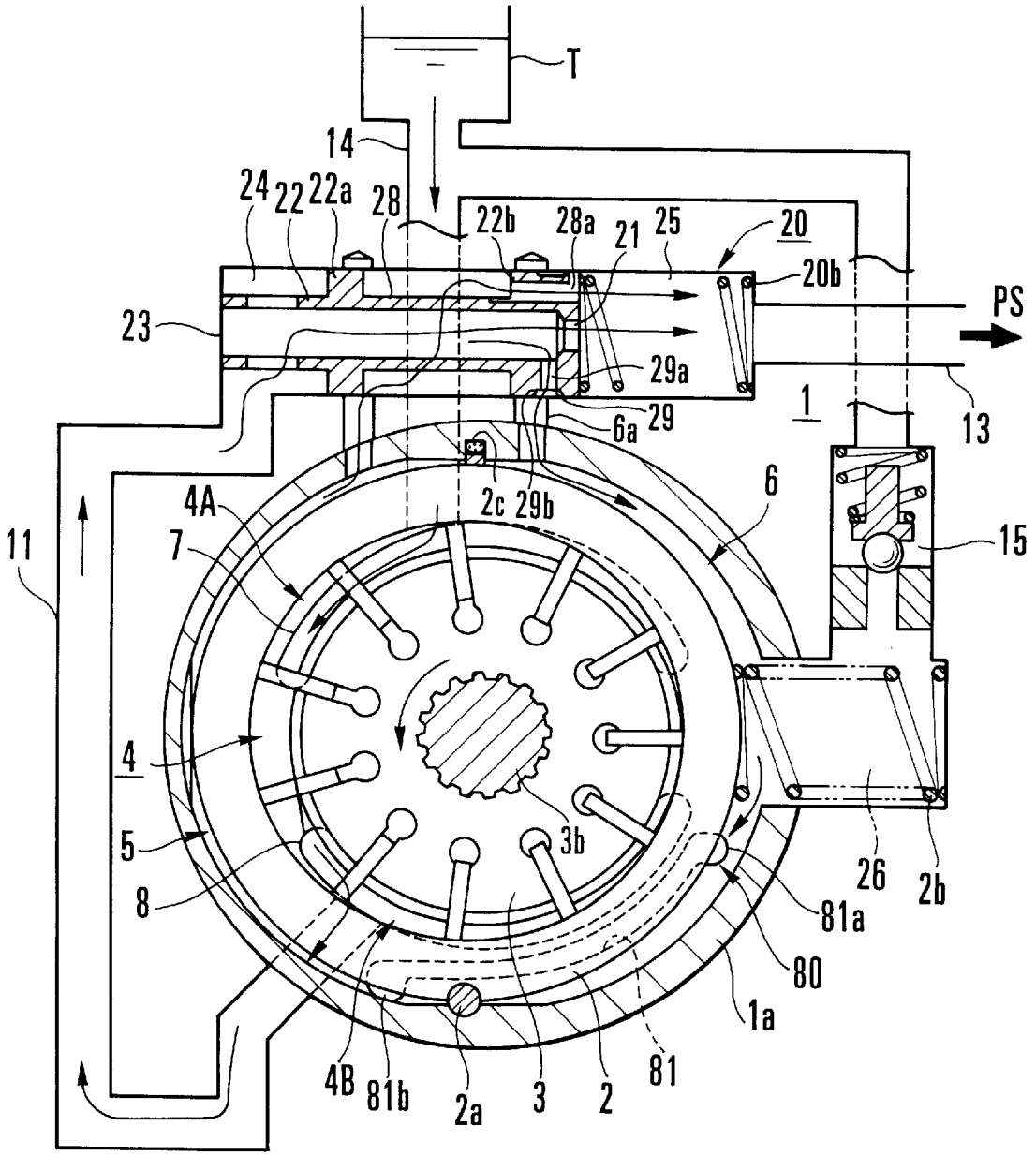
FIG. 13 is a view showing a variable displacement pump according to the second embodiment of the present invention to explain a state during low-speed rotation (immediately before a–b of FIG. 4)

In the first embodiment, the variable metering restrictor 27 comprised of the small hole 27*a* of the pump discharge path 11*a* that opens to the pressure plate is provided such that the small hole 27*a* is opened/closed by the side edge 27*b* of the cam ring 2. In the second embodiment, in place of the variable metering restrictor 27, a variable metering restrictor 80 comprised of an arcuate groove 81 is provided, as shown in FIG. 13. The second embodiment is different from the first embodiment in this respect.

Figure 14:
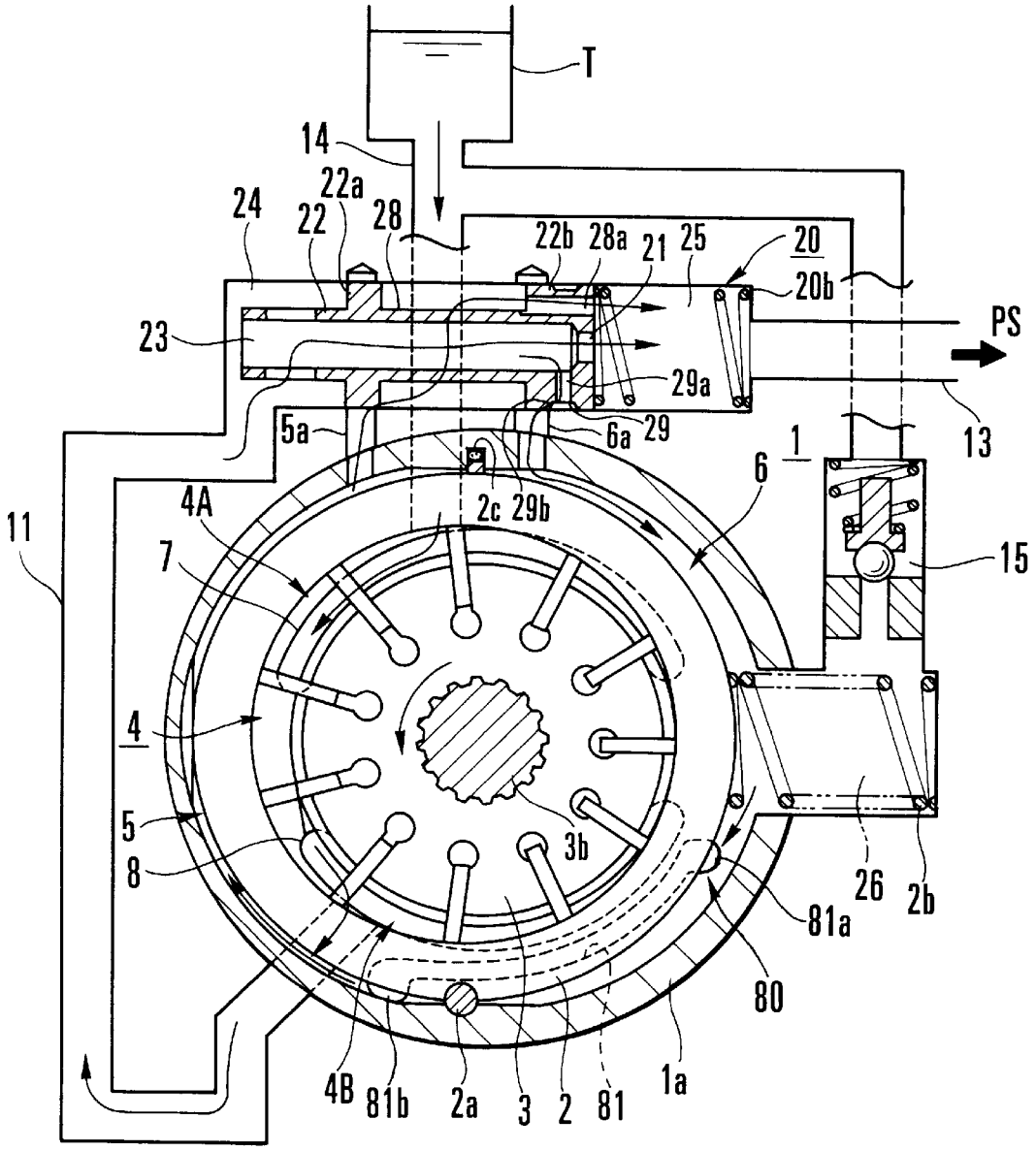
FIG. 14 is a view for explaining a state during medium-speed rotation (b of FIG. 4) of the variable displacement pump shown in FIG. 13.
Figure 15:
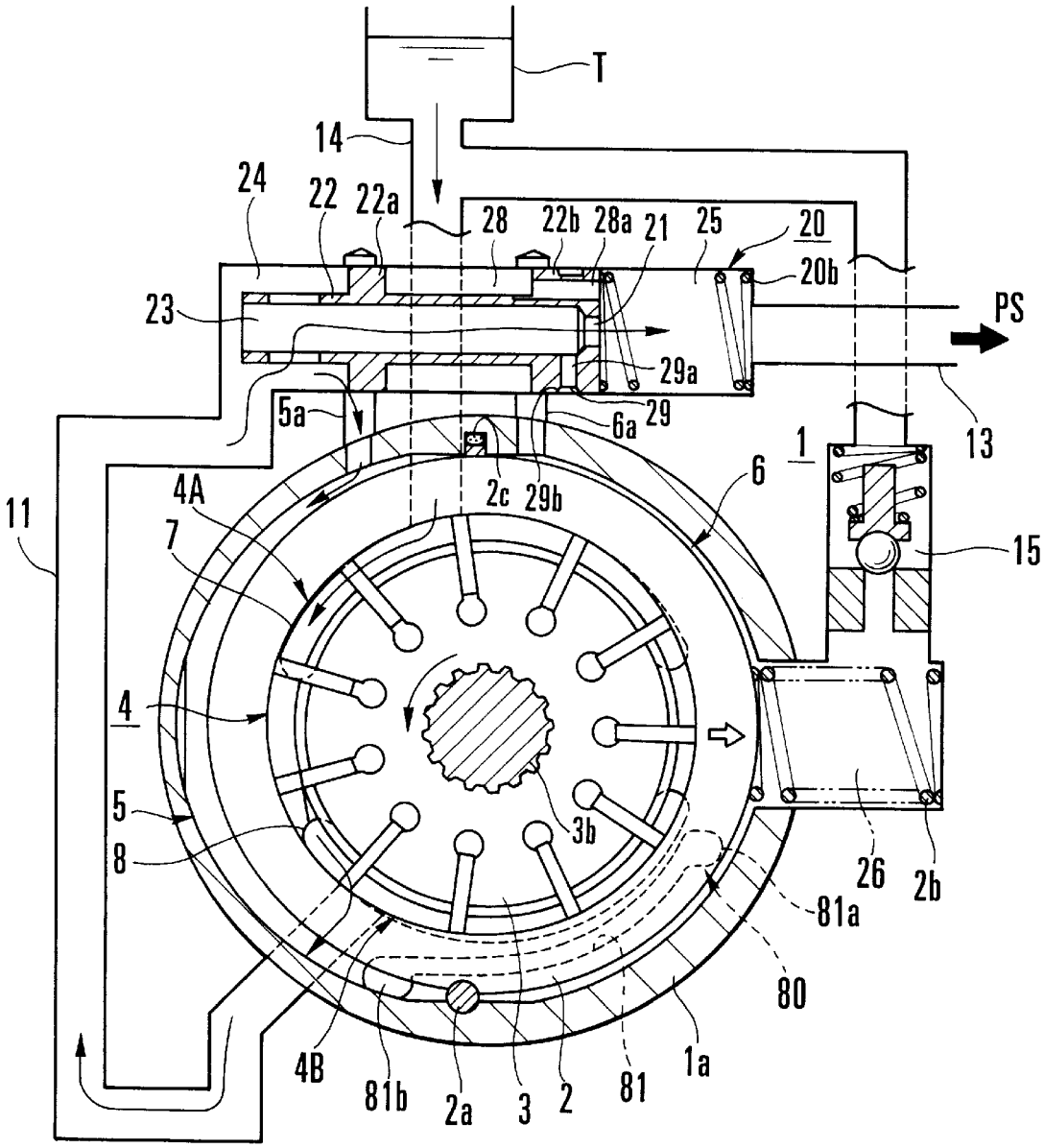
FIG. 15 is a view for explaining a state during high-speed rotation (b–e of FIG. 4) of the variable displacement pump shown in FIG. 13.
Figures 16A, 16B:
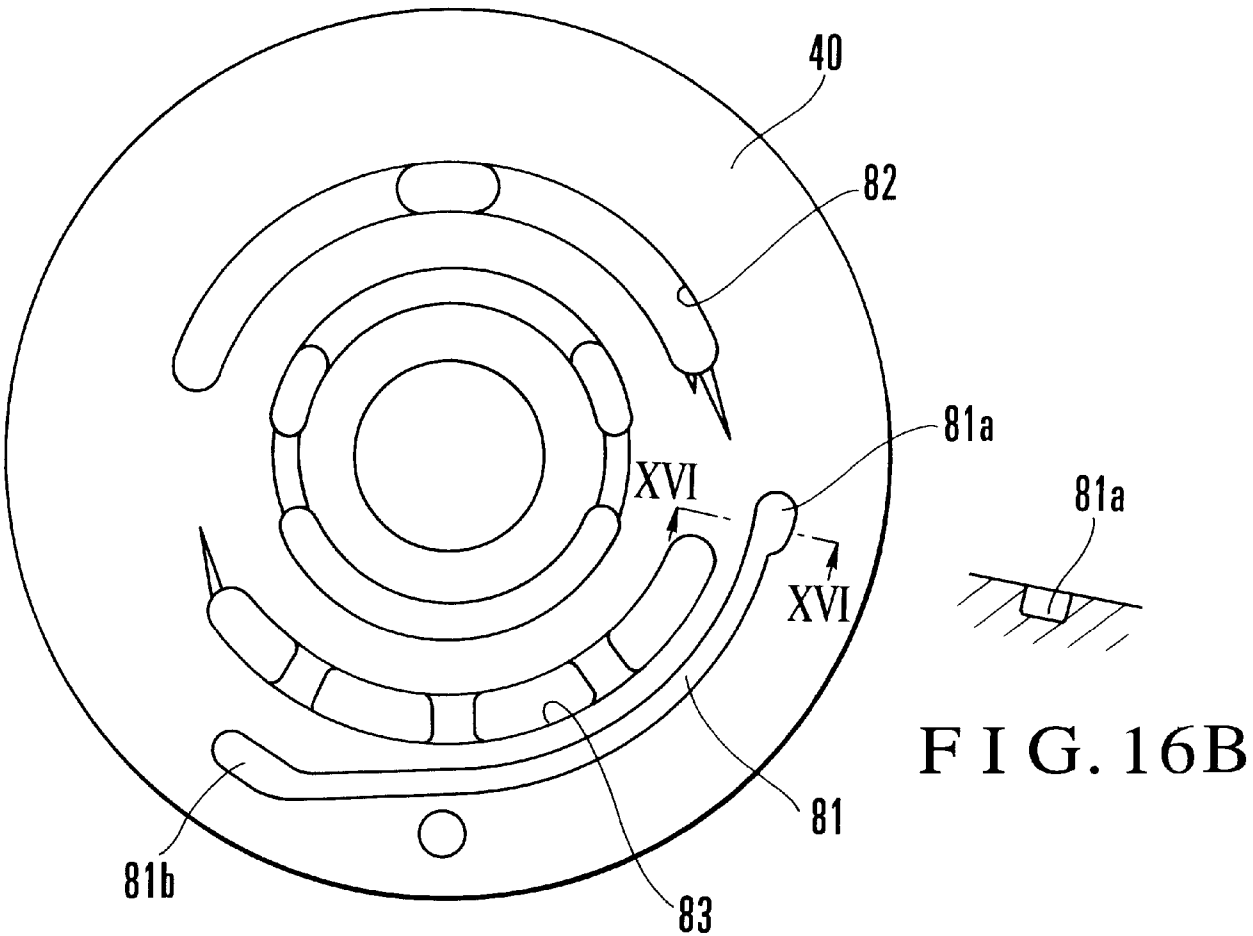
FIG. 16A is a view for explaining an arcuate groove that forms a variable metering restrictor formed in a pressure plate in the pump shown in FIGS. 13 to 15.
FIG. 16B is a sectional view taken along the line XVI—XVI of FIG. 16A.

FIG. 16A shows the surface of a pressure plate 40 identical to that described with reference to FIG. 11, which is in contact with a cam ring 37. The arcuate groove 81 is formed together with an arcuate groove 82 corresponding to a pump suction opening, and a pump discharge opening 83. As shown in FIGS. 13 to 15, the arcuate groove 81 is located such that its one end 81*a* is opened/closed by swing of a cam ring 2 in a second fluid pressure chamber 6 and its other end 81*b* opens to a first fluid pressure chamber 5.

In this second embodiment, when the pump rotates at a low or medium rotational speed, the state as shown in FIG. 13 or 14 is obtained. More specifically, the fluid pressure from a discharge path 11 obtained upstream of a stationary metering restrictor 21 is introduced to the second fluid pressure chamber 6 through a path hole 29*a* of a spool 22, an annular groove 29, a chamfer 29*b*, and a path 6*a*. The pressure fluid is then introduced from the second fluid pressure chamber 6 to the first fluid pressure chamber 5 through one end 81*a* of the arcuate groove 81 as the variable metering restrictor 80. Hence, a differential pressure generated by the variable metering restrictor 80 acts on the first fluid pressure chamber 5 with respect to the second fluid pressure chamber 6.

When the pump rotates at a high speed, the spool 22 moves to the right in FIG. 15. The fluid pressure obtained upstream of the stationary metering restrictor 21 is introduced to the first fluid pressure chamber 5, in a manner opposite to that described above, and a fluid pressure obtained downstream of the stationary metering restrictor 21 is introduced to the second fluid pressure chamber 6, so the cam ring 2 swings toward a spring chamber 26. Then, one end 81*a* of the arcuate groove 81 which forms the variable metering restrictor 80 is closed.

With this pump structure according to the second embodiment as well, differential pressures generated by the stationary metering restrictor 21 and variable metering restrictor 80 act on the first and second fluid pressure chambers 5 and 6, in the same manner as that described above, and a pressure difference between them is small. When the state shown in FIGS. 13 to 15 is shifted to a load state wherein the pressure fluid utilizing equipment is actuated, the fluid pressure of the first fluid pressure chamber 5 becomes larger than that of the second fluid pressure chamber 6, and a necessary relief state is obtained, in the same manner as that described in the first embodiment.

In the second embodiment described above shown in FIGS. 13 to 15, a pilot type relief valve 15 is provided to a pilot path which is different from the discharge path 11 or 13. However, the present invention is not limited to this.

Figure 17:
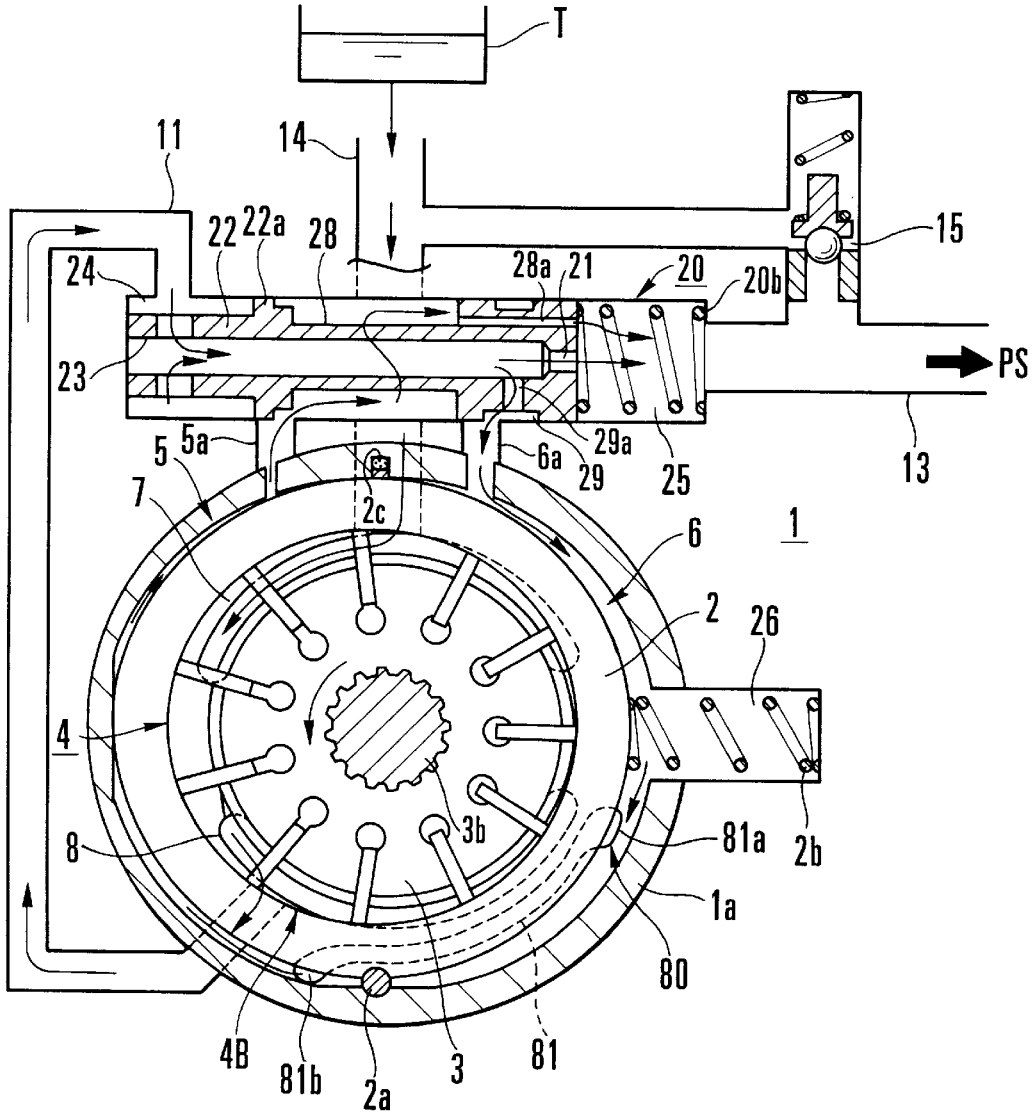
FIG. 17 is a view showing a variable displacement pump according to the third embodiment of the present invention to explain a state during low-speed rotation.
Figure 18:
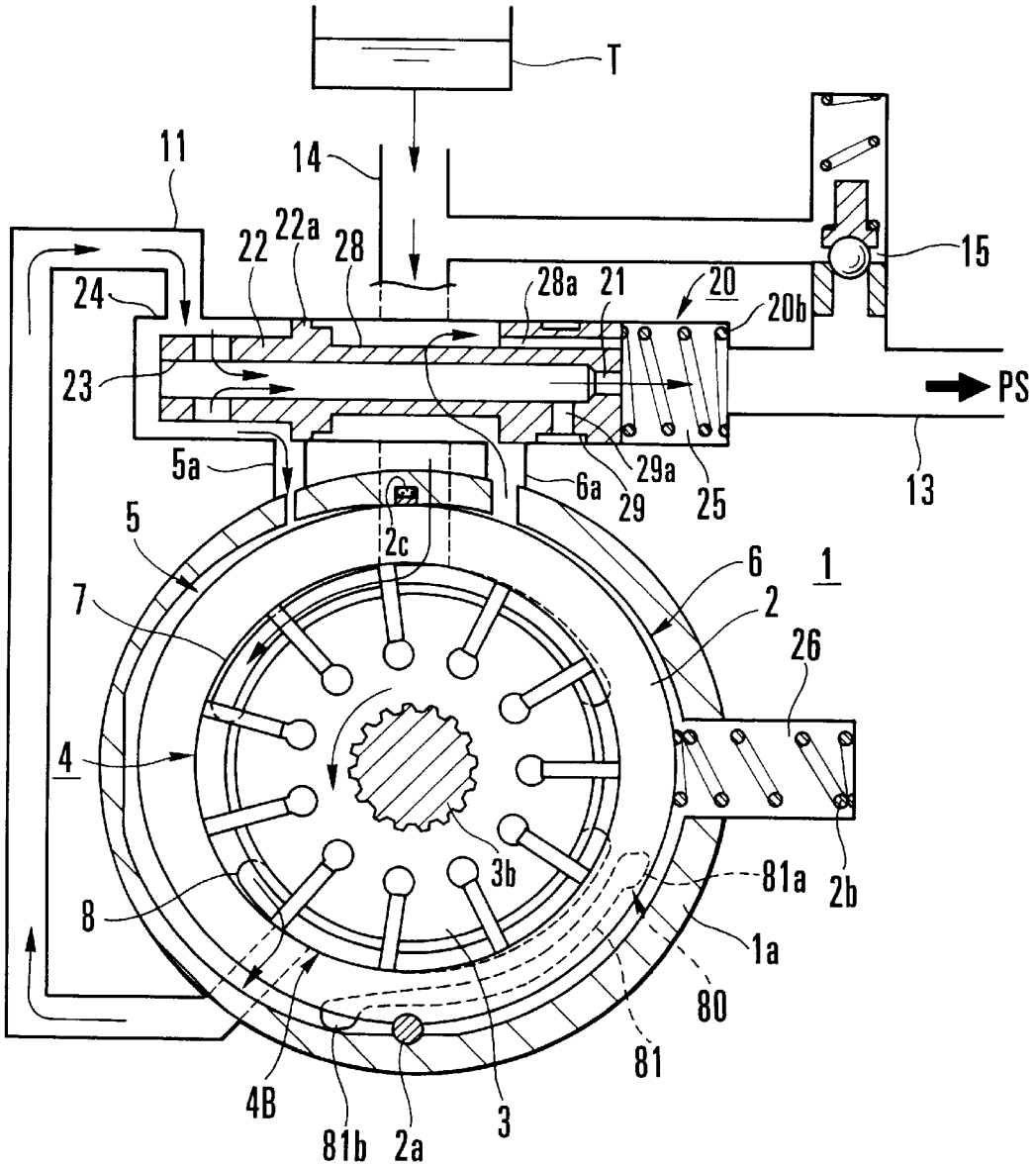
FIG. 18 is a view for explaining a state during high-speed rotation of the variable displacement pump shown in FIG. 17.
Figure 19:
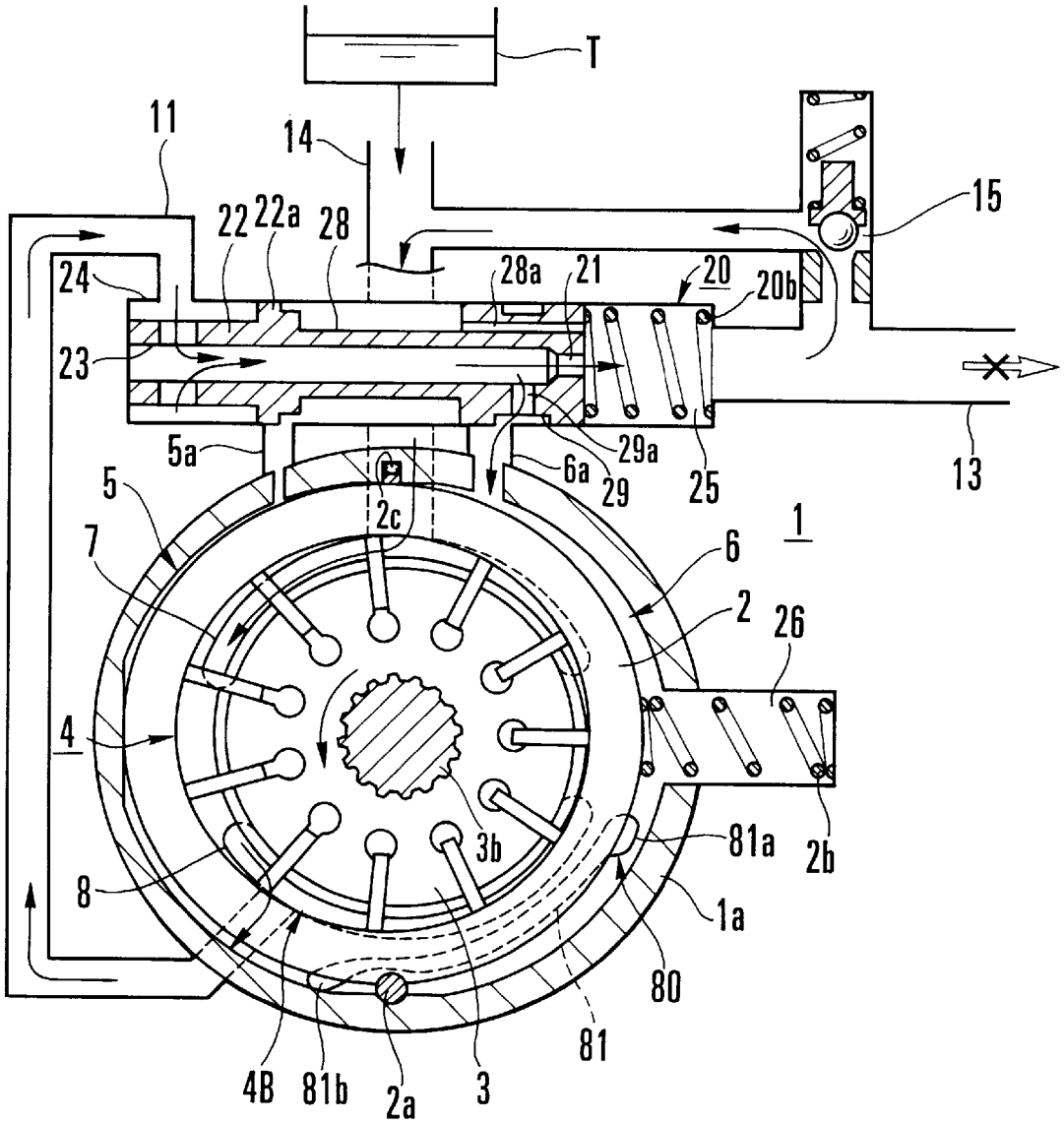
FIG. 19 is a view for explaining a relief state during low-speed rotation of the variable displacement pump shown in FIG. 17.

FIGS. 17 to 19 show the third embodiment of the present invention. In this embodiment, a direct coupled type relief valve 15 is provided in a pump discharge path in order to return the pressure fluid from a path 13 formed downstream of a stationary metering restrictor 21 to a pump suction path 14.

With this structure as well, the same function and effect as those of the embodiments described above can be obtained, and a detailed description on an operation thereof will be omitted.

Figure 20:
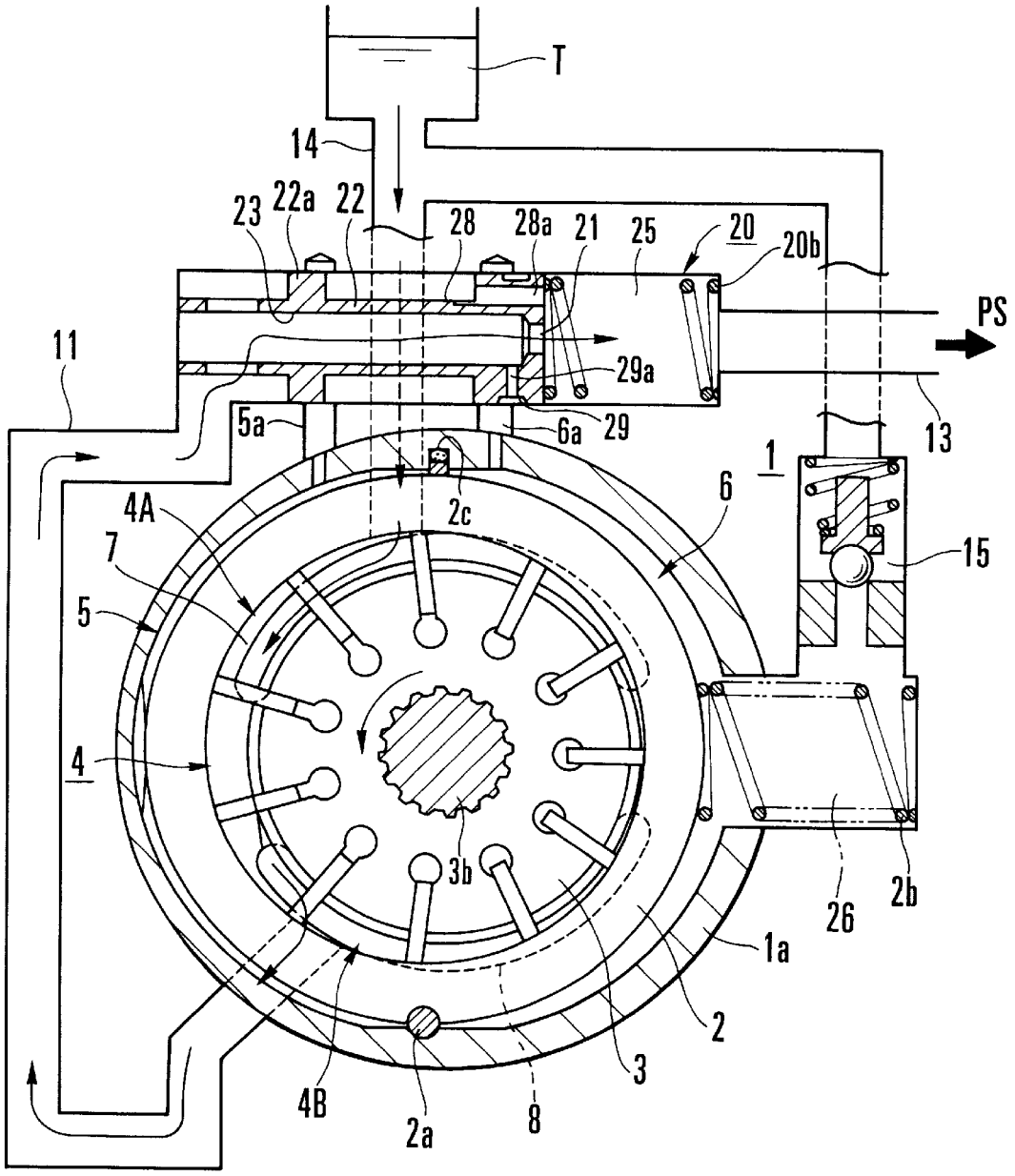
FIG. 20 is a view showing a variable displacement pump according to the fourth embodiment of the present invention to explain a state during low-speed rotation (immediately before a–b of FIG. 23)
Figure 21:
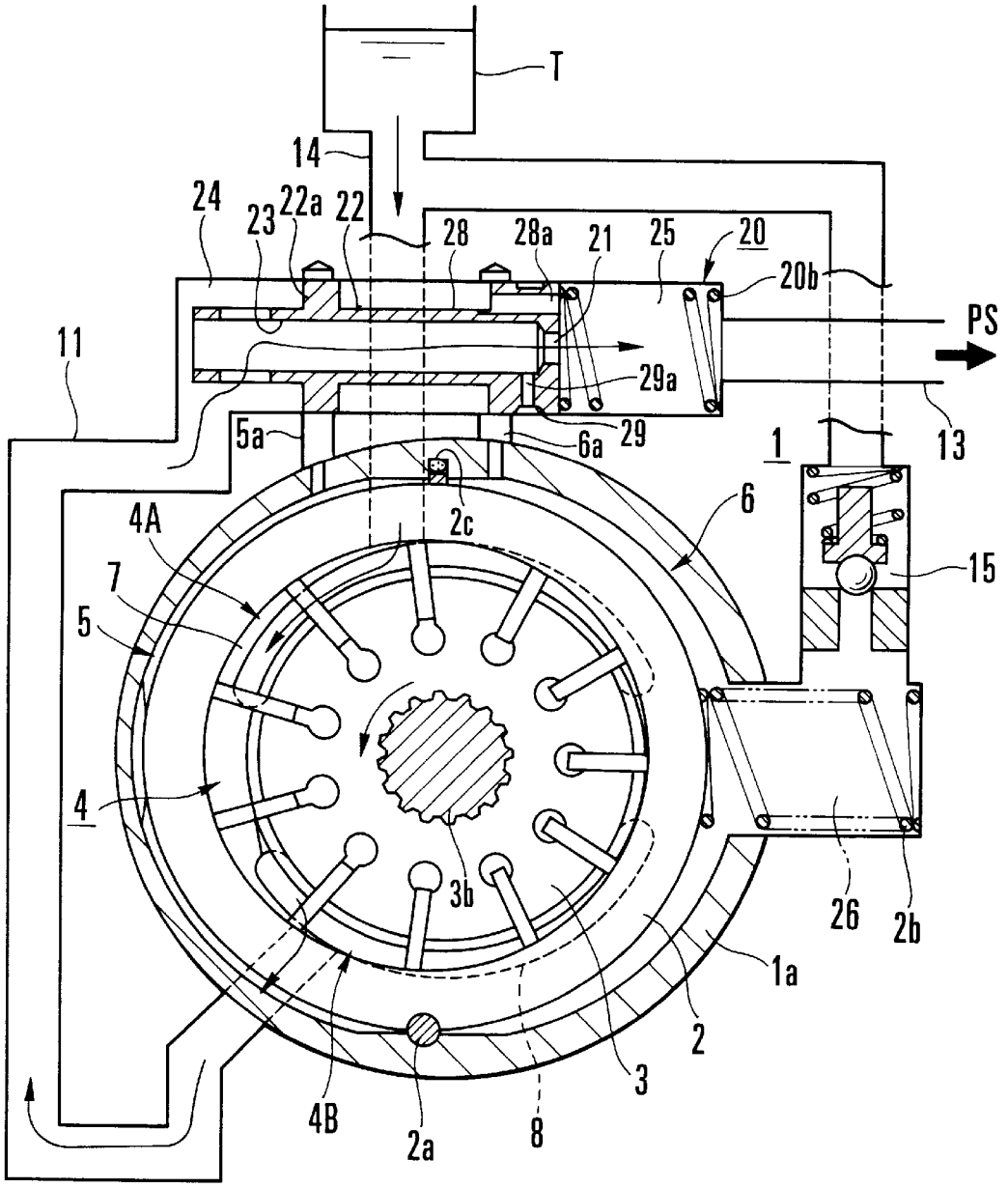
FIG. 21 is a view for explaining a state during medium-speed rotation (b of FIG. 23) of the variable displacement pump shown in FIG. 20.
Figure 22:
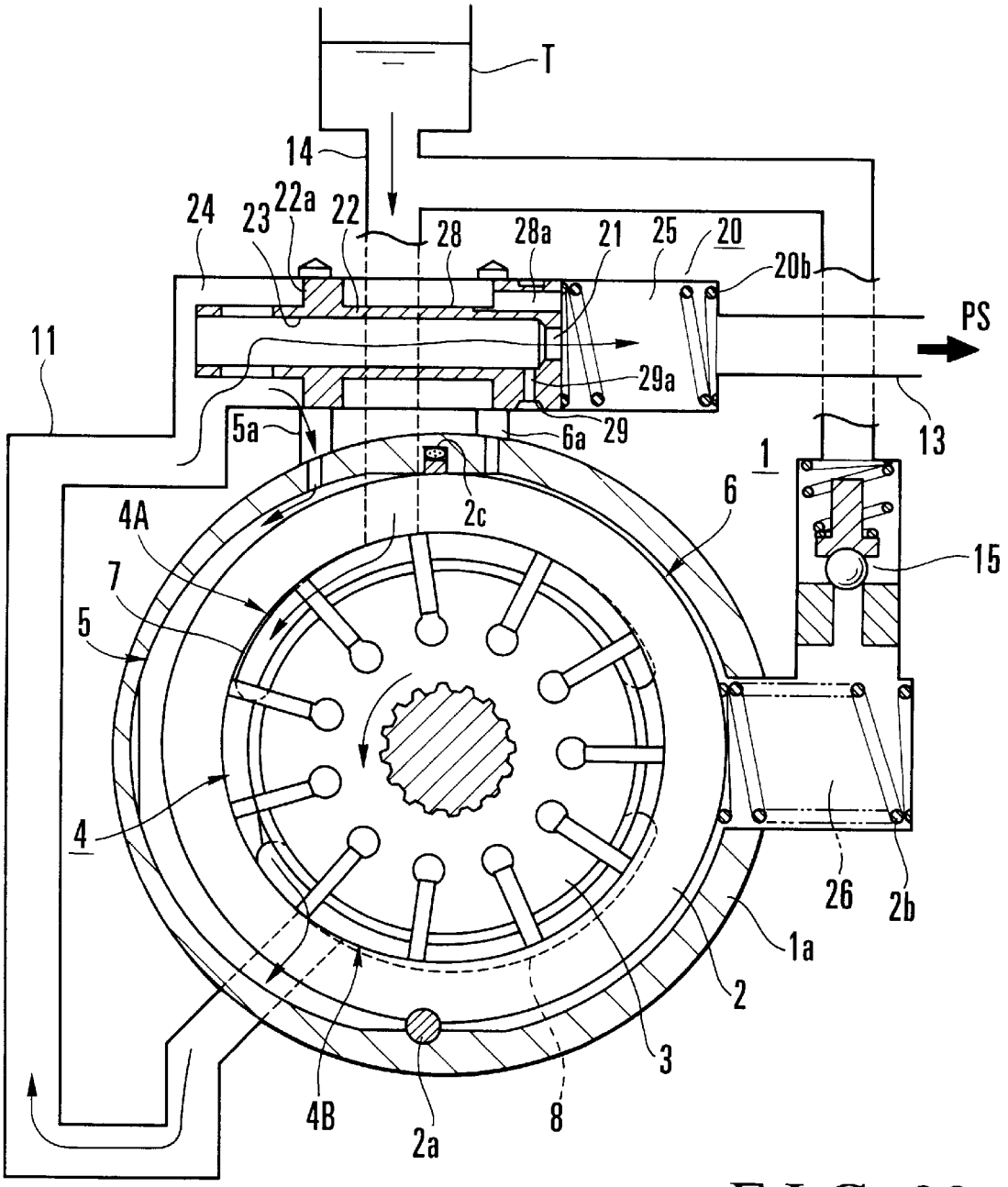
FIG. 22 is a view for explaining a state during high-speed rotation (b–c of FIG. 23) of the variable displacement pump shown in FIG. 20.
Figure 23:
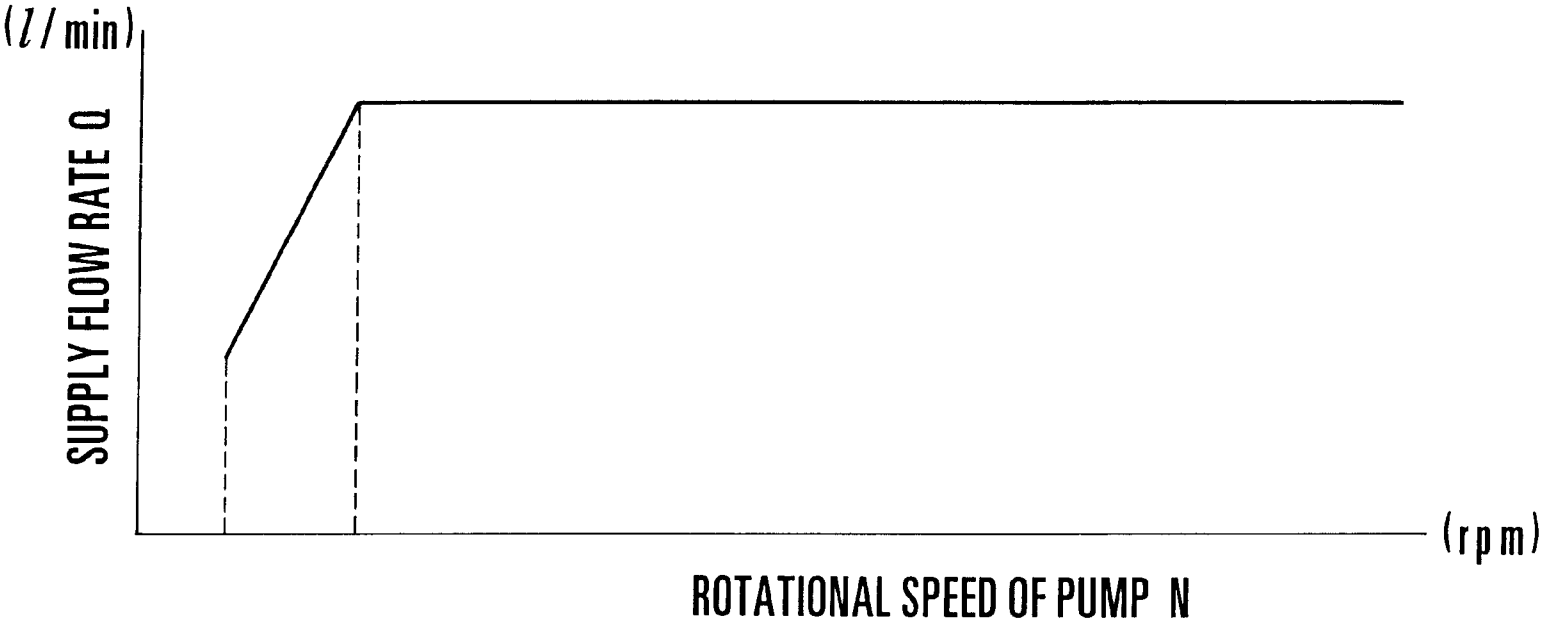
FIG. 23 is a graph explaining the supply flow rate as a function of the pump rotational speed of the variable displacement pump shown in FIGS. 20 to 22.

FIGS. 20 to 22 show the fourth embodiment of the present invention. In this embodiment, unlike the pumps described above in the first to third embodiments, a variable metering restrictor is omitted, and only a stationary metering restrictor 21 is provided between pump discharge paths 11 and 13. The pump of this embodiment is a constant flow rate type pump, in which the supply flow rate from the pump is constant, as shown in FIG. 23.

The pump of this embodiment is obtained by removing the variable metering restrictor from the pump of the first, second, or third embodiment, and a detailed description thereof will be omitted.

More specifically, in the pump of this embodiment, when the rotational speed of the pump is small, a fluid pressure of the pump discharge path 13 which is obtained downstream of the stationary metering restrictor 21 is introduced to a first fluid pressure chamber 5, and a fluid pressure obtained upstream of the stationary metering restrictor 21 is introduced to a second fluid pressure chamber 6. When the rotational speed of the pump becomes equal to or more than a predetermined value and the pump discharge fluid pressure obtained upstream of the stationary metering restrictor 21 becomes a predetermined value or more, a spool 22 constituting a spool type control valve 20 moves to introduce this fluid pressure to the high-pressure fluid pressure chamber 5. Meanwhile, the fluid pressure obtained downstream of the stationary metering restrictor 21 is introduced to the second fluid pressure chamber 6, and a cam ring 2 is displaced by the differential pressures of the first and second fluid pressure chambers 5 and 6 in a direction to reduce a pump chamber 4. Hence, the discharge flow rate from the pump is maintained at a constant value regardless of the rotational speed of the pump.

When, for example, a pressure fluid utilizing equipment PS is actuated and the fluid pressures in the pump discharge paths 11 and 13 become equal to or more than a predetermined pressure (relief pressure), a relief valve 15 is opened to relieve the fluid pressure to the pump suction side. In this relief state, since the fluid pressure of the second fluid pressure chamber 6 further decreases, the cam ring 2 is displaced in a direction to further reduce the pump chamber 4, thereby further decreasing the discharge flow rate from the pump chamber 4.

With this fourth embodiment as well, the function and effect identical to those of the first, second, and third embodiments described above can be obtained.

Figure 24B:
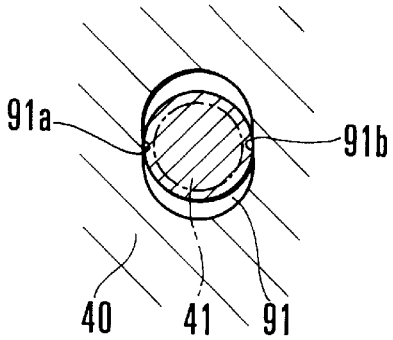
Figure 24C:
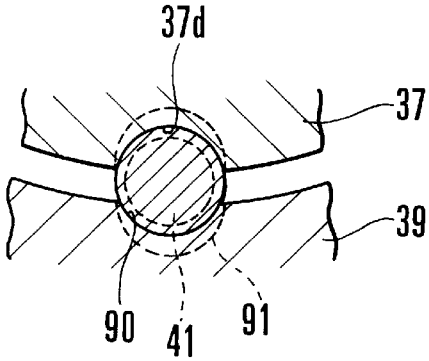

FIGS. 24A, 24B, and 24C show the fifth embodiment of the present invention. In this embodiment, a swing fulcrum pin 41 (2*a*) identical to those described above in the respective embodiments is a barrel-shaped round rod formed of a curved surface such that its diameter is the maximum at the central portion in the axial direction and decreases gradually toward two ends.

With the swing fulcrum pin 41 having this shape, a cam ring 37 can be supported reliably, and a smooth swing motion of the cam ring 37 can be obtained. When this swing fulcrum pin 41 is used, although the function as the seal pin is somewhat degraded, no problem occurs in practice as far as the fluid pressure difference between fluid pressure chambers 5 and 6 on two sides of the cam ring 37 is small, as described above.

More specifically, to simply support a recess 37*d* of the cam ring 37 with the swing fulcrum pin 41 described above, the recess 37*d* must have high machining precision in the axial direction. Since the pin 41 of this embodiment having a curved surface supports the cam ring 37 at one point in the axial direction, reliable support can be maintained without requiring high-precision machining. This is advantageous in terms of machinability and manufacturing cost.

In a conventional structure, a recess 90 of an adapter ring 39 that supports this pin 41 must also have high precision. If the recess is formed as described in this embodiment, high-precision machining is not necessary.

In this embodiment, the swing fulcrum pin 41 for swingably supporting the cam ring 37 in the pump body (adapter ring 39) is supported by the recess 90 formed in the inner surface of the adapter ring 39. Holes to engage with the two ends of the swing fulcrum pin 41 are respectively comprised of substantially oval elongated holes 91 formed in the plates on two sides (a side plate on the inner surface of a rear body 32 and a pressure plate 40) that sandwich pump constituent elements 33 in the pump body.

More specifically, the conventional swing fulcrum pin 41 is supported by circular holes respectively formed in the inner surface of the rear body 32 and the pressure plate 40 on two sides that sandwich the pump constituent elements 33, and is not received by the recess in an adapter ring 39. In contrast to this, in the present invention, the swing fulcrum pin 41 is directly received and supported by the recess 90 of the adapter ring 39, while the two ends of the swing fulcrum pin 41 are movable.

With this structure, the swing fulcrum pin 41 is mostly held in the axial direction by the groove bottom of the recess 90, so that the swing fulcrum pin 41 can serve as the swing fulcrum of the cam ring 37, the seal pin between the first and second fluid pressure chambers 5 and 6 (53 and 54), and a positioning pin for the rear body 32 and pressure plate 40.

The elongated holes 91 to engage with the two ends of the swing fulcrum pin 41 are formed as elongated holes that can allow movements of the ends of the swing fulcrum pin 41 when a load, e.g., a discharge pressure, acts on the discharge region in a pump chamber 38 through the cam ring 37. It is confirmed that when the diameter of the swing fulcrum pin 41 is, e.g., 3.0 mm, the diameter of the large-diameter portion of each substantially oval elongated hole 91 is preferably 3.3 mm.

Each substantially oval elongated hole 91 obviously has parallel portions 91*a* and 91*b*, opposing each other through a gap that matches the diameter of the swing fulcrum pin 41, to allow positioning of the rear body 32 and pressure plate 40 in the rotational direction. The size of the short side of the elongated hole 91 is fixed.

The parallel portions 91*a* and 91*b* extend in such a direction that the discharge pressure at the discharge region of the pump chamber 38 acts on the cam ring 37.

With this structure, the swing fulcrum pin 41 is mostly supported in the axial direction by the recess 90 of the adapter ring 39, so the function as the swing fulcrum for the cam ring 37 can be assured. Unlike in the conventional case, the pin 41 does not fall regardless of the load acting on it through the cam ring 37 due to the influence of the fluctuating fluid pressure at the pump discharge region in the pump chamber 38, and the cam ring 37 can swing smoothly. This is because the cam ring 37 is reliably supported at one portion by the pin 41 formed to have a curved surface in the axial direction.

The cam ring 37 swings smoothly even in a flow rate adjustment area where the pump discharge flow rate is adjusted by the swing motion of the cam ring 37. Therefore, the flow rate characteristics of the pump can be stabilized.

With the arrangement described above, the holes to engage with the two ends of the swing fulcrum pin 41 are comprised of holes 91 elongated in the direction of the load to act on the cam ring 37. Therefore, the problem on strength at the pin support portions on the rear body 32 and pressure plate 40 can be solved as compared to the conventional case. In addition, since the support strength of the swing fulcrum pin 41 increases, the pump discharge pressure can be increased.

The holes to be respectively formed in the pressure plate 40 and rear body 32 that support the two ends of the swing fulcrum pin 41 can apparently be simple circular holes as far as their machining precision can be assured.

The present invention is not limited to the structures of the embodiments described above, and the shapes, structures, and the like of the respective portions of the variable displacement pump 30 are free to modify and change appropriately. Various types of modifications are possible.

In each embodiment describe above, a simple term "restrictor" is employed, like the stationary metering restrictor 21 and the variable metering restrictors 27 and 80. This is because the restricting portion can be an orifice or choke.

As has been described above, in the variable displacement pump according to the present invention, pressures related to the fluid pressures obtained upstream and downstream of the metering restrictor are introduced to the first and second fluid pressure chambers formed on two sides of the cam ring, in the entire rotational speed range of the pump. Therefore, leakage in the pump can be relatively decreased. According to the present invention, a portion in the pump where the fluid pressure difference is large can be omitted, so that a seal portion requiring a sufficiently high pressure resistance can be removed.

According to the present invention, since the pressure difference to be controlled by the control valve becomes small, stable control operation can be performed. For example, even if the pressure difference between pressures present upstream and downstream of the variable metering restrictor is as small as about 2 kgf/cm$^2$, the cam ring can swing appropriately.

Furthermore, the pressure difference described above between pressures present upstream and downstream of the metering restrictor is constant regardless of whether the load is applied or not upon operating/stopping the pressure fluid utilizing equipment to which a pressure fluid is supplied from the pump. Even when the open area of the control valve is increased, a large passing flow rate is not required, and stable control operation can be performed. Since the passing flow rate through the control valve described above is directly discharged from the pump, the metering restrictor may be set by considering this respect, so the problem of internal leakage is solved.

These advantages are obtained due to the following reason. The pressure difference to be distribution-controlled by the lands of the control valve need not be large, unlike the one between a tank pressure and a pump discharge pressure in the conventional case, but can be small, like the one between pressures present upstream and downstream of the metering restrictor. Hence, the leak amounts from the lands of the control valve become small.

According to the present invention, the fluid pressures present upstream and downstream of the metering restrictor can be supplied by the control valve to the first and second fluid pressure chambers reversely when the pump rotates at a low speed and a high speed. Therefore, the swing motion of the cam ring that takes place in the return mode wherein the pump rotational speed shifts from a high speed to a low speed becomes smooth.

According to the present invention, the biasing force of the spring means is set to an appropriate value. Thus, at a region on the inner surface of the cam ring where the pump discharge fluid pressure acts, the forces on the right and left sides of the swing fulcrum pin of the cam ring can be balanced, so that the cam ring swings in an appropriate state.

What is claimed is:

1. A variable displacement pump comprising:

a pump body having an inner space and formed with a suction path and discharge paths communicating with said inner space;

a cam ring having a swing fulcrum pin on part of an outer surface thereof to extend in an axial direction, and swingably supported in said inner space of said pump body through said swing fulcrum pin as a fulcrum;

a rotor having vanes and arranged inside said cam ring to be eccentric on one side of said cam ring;

a rotating shaft mounted on an axis of said rotor and axially supported by said pump body;

a pump chamber having an opening for said suction path and an opening for said discharge path and formed between an inner surface of said cam ring and an outer surface of said rotor;

first and second fluid pressure chambers divisionally formed between said inner space of said pump body and an outer surface of said cam ring through seal means including said swing fulcrum pin;

biasing means for biasing said cam ring from said second fluid pressure chamber toward said first fluid pressure chamber;

a metering restrictor provided between said discharge paths; and a control valve connected to said discharge paths formed upstream and downstream, respectively, of said metering restrictor and to said first and second fluid pressure chambers and driven by fluid pressures present upstream and downstream of said metering restrictor, wherein said control valve connects each of said first and second fluid pressure chambers to either one of said discharge paths formed upstream and downstream, respectively, of said metering restrictor, and selectively supplies one of the fluid pressures present upstream and downstream of said metering restrictor to said first and second fluid pressure chambers.

2. A pump according to claim 1, wherein said control valve performs control operation such that when said pump rotates at a low speed, downstream and upstream sides of said metering restrictor are respectively connected to said first and second fluid pressure chambers.

3. A pump according to claim 1, wherein said control valve performs control operation such that when said pump rotates at a high speed, said upstream and downstream sides of said metering restrictor are respectively connected to said first and second fluid pressure chambers.

4. A pump according to claim 1, wherein said control valve comprises a movable spool formed with a fluid path and said metering restrictor.

5. A pump according to claim 1, wherein said control valve is integrally formed with said discharge paths in said pump body.

6. A pump according to claim 1, wherein said biasing means is formed to absorb the difference as a result of the unbalanced force applied from the inside of said pump chamber to the inner surface of said cam ring on both sides of the oscillating directions and to have a biasing force larger than the balancing force on both sides of said oscillating directions.

7. A pump according to claim 1, wherein said swing fulcrum pin is barrel-shaped such that a diameter thereof gradually decreases from a central portion toward two ends in an axial direction.

* * * * *